US010207400B2

(12) United States Patent
Gallegos

(10) Patent No.: US 10,207,400 B2
(45) Date of Patent: Feb. 19, 2019

(54) ADJUSTABLE TOOL HANDLE FOR HOLDING A TOOL DURING USE

(71) Applicant: WAGIC, INC., San Jose, CA (US)

(72) Inventor: Robert J. Gallegos, Fremont, CA (US)

(73) Assignee: WAGIC, INC., San Jose, CA (US)

( * ) Notice: Subject to any disclaimer, the term of this patent is extended or adjusted under 35 U.S.C. 154(b) by 0 days.

(21) Appl. No.: 14/918,372

(22) Filed: Oct. 20, 2015

(65) Prior Publication Data

US 2016/0039083 A1 Feb. 11, 2016

Related U.S. Application Data

(62) Division of application No. 13/472,350, filed on May 15, 2012, now Pat. No. 9,193,058.

(51) Int. Cl.

| | |
|---|---|
| ***B25G 3/12*** | (2006.01) |
| ***B25G 1/06*** | (2006.01) |
| ***B25G 3/24*** | (2006.01) |
| ***B25B 15/00*** | (2006.01) |
| ***B25B 15/04*** | (2006.01) |

(52) U.S. Cl.

CPC ..... *B25G 1/063* (2013.01); *B25B 15/008* (2013.01); *B25B 15/04* (2013.01); *B25G 1/06* (2013.01); *B25G 3/12* (2013.01); *B25G 3/24* (2013.01); *Y10T 29/49826* (2015.01)

(58) Field of Classification Search

CPC . B25G 1/063; B25G 3/12; B25G 3/24; B25G 1/06; B25B 15/008; B25B 15/04; Y10T 29/49826

See application file for complete search history.

(56) References Cited

U.S. PATENT DOCUMENTS

| | | | |
|---|---|---|---|
| 244,309 | A | 7/1881 | Rhodes |
| 363,331 | A | 5/1887 | Hammer |
| 364,422 | A | 6/1887 | LaForge |
| 580,235 | A | 4/1897 | Strum |

(Continued)

FOREIGN PATENT DOCUMENTS

| | | |
|---|---|---|
| CA | 1147176 | 5/1983 |
| CA | 1232781 | 2/1988 |

(Continued)

OTHER PUBLICATIONS

Wagic Husky 26pc Sae& Metric Ball-Head Key Set w/ Torque Handle, http://www.bing.com/shopping/wagic-husky-26pc-sae-metric-ball-head-hex-key-set-w-for . . . , May 10, 2012.

*Primary Examiner* — Sarang Afzali
*Assistant Examiner* — Ruth G Hidalgo-Hernandez
(74) *Attorney, Agent, or Firm* — Haverstock & Owens LLP

(57) ABSTRACT

An adjustable tool handle for holding a tool during use provides an improved handling of tools during use of tools that are difficult to use on their own, specifically L-shaped hexagonal wrenches. The adjustable tool handle includes a tool handle body with a handle and an adjustable opening for receiving a tool. In order to place a tool within the tool handle, a user opens the tool handle. When the tool handle is open, one leg of the tool handle is inserted into one of a plurality of openings on the back of the body and the other leg is placed within the adjustable opening. After the tool is placed within the tool handle, the tool is held in place by a securing mechanism. With the tool coupled to the tool handle, a user is able to tighten and loosen work pieces of different sizes and different types.

15 Claims, 14 Drawing Sheets

(56) References Cited

U.S. PATENT DOCUMENTS

| | | | |
|---|---|---|---|
| 647,528 | A | 4/1900 | Schmidt |
| 655,007 | A | 7/1900 | Rairigh |
| 696,995 | A | 4/1902 | Moser |
| 763,745 | A | 6/1904 | Gheen |
| 776,761 | A | 12/1904 | Sampson |
| 873,363 | A | 12/1907 | Ross |
| 875,493 | A | 12/1907 | Beard |
| 890,150 | A | 6/1908 | Marble |
| 959,408 | A | 5/1910 | Volbert |
| 1,000,900 | A | 8/1911 | Dorsey |
| 1,006,679 | A | 10/1911 | Rice |
| 1,100,070 | A | 6/1914 | Graham |
| 1,172,656 | A | 2/1916 | Yorgensen |
| 1,187,542 | A | 6/1916 | Kaas |
| D53,597 | S | 7/1919 | Marcmann |
| 1,337,769 | A | 4/1920 | Hemming |
| 1,398,583 | A | 11/1921 | Bovee |
| 1,425,270 | A | 8/1922 | Morgan |
| 1,500,852 | A | 7/1924 | Shepard |
| 1,502,044 | A | 7/1924 | McCann |
| 1,530,905 | A | 3/1925 | Nance |
| 1,559,097 | A | 10/1925 | Hill |
| 1,753,026 | A | 4/1930 | Rosati |
| 1,825,936 | A | 10/1931 | Bodmer |
| 1,888,222 | A | 11/1932 | Curtis et al. |
| 1,915,245 | A | 6/1933 | Cook |
| 1,944,606 | A | 1/1934 | Little |
| 1,970,409 | A | 8/1934 | Wiedemann |
| 1,973,188 | A | 9/1934 | Verderber |
| 2,236,333 | A | 3/1941 | Cowles |
| 2,332,656 | A | 10/1943 | Mirando |
| 2,346,364 | A | 4/1944 | Dowe |
| D142,982 | S | 11/1945 | Bloomfield |
| 2,409,613 | A | 10/1946 | Brooks |
| 2,410,971 | A | 11/1946 | Hartley |
| 2,465,152 | A | 3/1949 | Ellison |
| 2,465,619 | A | 3/1949 | Veit |
| 2,475,268 | A | 7/1949 | Wittle |
| 2,485,991 | A | 10/1949 | Stowell |
| D156,677 | S | 12/1949 | Smith |
| D157,154 | S | 2/1950 | Horton |
| 2,509,507 | A | 5/1950 | Kane |
| 2,512,967 | A | 6/1950 | Quiron |
| 2,530,024 | A | 11/1950 | Moody |
| 2,532,636 | A | 12/1950 | Minnich |
| 2,569,069 | A | 9/1951 | Motel |
| 2,590,307 | A | 3/1952 | Gibson |
| 2,593,828 | A | 4/1952 | Arey |
| 2,604,211 | A | 7/1952 | Steine |
| 2,701,052 | A | 2/1955 | Mantel |
| D175,056 | S | 6/1955 | Wilson |
| 2,715,028 | A | 8/1955 | Dossie |
| 2,719,042 | A | 9/1955 | Epsy |
| 2,726,091 | A | 12/1955 | Topar |
| 2,776,589 | A | 1/1957 | Gregory |
| 2,778,396 | A | 1/1957 | Swain |
| 2,786,380 | A | 3/1957 | Rolland |
| D179,979 | S | 4/1957 | Noga |
| 2,797,599 | A | 7/1957 | McGarvie, Jr. |
| 2,800,816 | A | 7/1957 | Tasciotti |
| 2,804,970 | A | 9/1957 | Kuc et al. |
| 2,810,472 | A | 10/1957 | Midkiff |
| 2,836,210 | A | 5/1958 | Garofalo |
| 2,842,020 | A | 7/1958 | Traquinio |
| 2,844,244 | A | 7/1958 | Hanson |
| 2,851,915 | A | 9/1958 | Martinez |
| 2,854,741 | A | 10/1958 | Cholger |
| 2,878,701 | A | 3/1959 | Weersma |
| 3,023,054 | A | 2/1962 | Shigekuni |
| 3,061,927 | A | 11/1962 | Von Frankenberg Und Ludwingdort |
| 3,113,479 | A | 12/1963 | Swingle |
| 3,156,143 | A | 11/1964 | Wolfe |
| 3,222,959 | A | 12/1965 | Clark |
| 3,255,792 | A | 6/1966 | Beck |
| 3,257,991 | A | 6/1966 | Mosch |
| D205,745 | S | 9/1966 | Namfeldt |
| 3,342,229 | A | 9/1967 | Janes |
| 3,343,434 | A | 9/1967 | Schroeder |
| 3,370,696 | A | 2/1968 | Gore |
| 3,424,039 | A | 1/1969 | Scott |
| 3,592,086 | A | 7/1971 | Derwin |
| 3,654,975 | A | 4/1972 | Ballsmith et al. |
| 3,667,518 | A | 6/1972 | Stillwagon, Jr. |
| 3,802,286 | A | 4/1974 | Winklofer et al. |
| 3,863,693 | A | 2/1975 | Carniker |
| 3,943,801 | A | 3/1976 | Yates |
| 3,958,469 | A | 5/1976 | Meese |
| 3,997,053 | A | 12/1976 | Bondhus |
| 4,000,767 | A | 1/1977 | Geng |
| 4,043,230 | A | 8/1977 | Scrivens |
| 4,124,915 | A | 11/1978 | Schlicher |
| 4,154,125 | A | 5/1979 | Frank |
| 4,196,761 | A | 4/1980 | Royer |
| 4,227,430 | A | 10/1980 | Jameson et al. |
| 4,235,269 | A | 11/1980 | Kraus |
| 4,238,862 | A | 12/1980 | Leatherman |
| 4,241,773 | A | 12/1980 | Personnat |
| 4,302,990 | A | 12/1981 | Chrichton et al. |
| 4,308,770 | A | 1/1982 | MacDonald |
| 4,310,094 | A | 1/1982 | Hotchkiss |
| 4,327,790 | A | 5/1982 | Stevens et al. |
| 4,384,499 | A | 5/1983 | Shockley |
| D270,024 | S | 8/1983 | Strasser |
| 4,424,728 | A | 1/1984 | MacDonald |
| 4,440,048 | A | 4/1984 | Stevens |
| 4,448,097 | A | 5/1984 | Rocca |
| 4,469,109 | A | 9/1984 | Mehl |
| 4,476,751 | A | 10/1984 | Mishima |
| 4,525,889 | A | 7/1985 | Dunau |
| 4,542,667 | A | 9/1985 | Jang |
| D284,810 | S | 7/1986 | Kelemen, Sr. |
| 4,598,822 | A | 7/1986 | Hemmings |
| 4,640,155 | A | 2/1987 | Condon |
| 4,667,822 | A | 5/1987 | Coopmans |
| 4,699,020 | A | 10/1987 | Bush et al. |
| 4,699,030 | A | 10/1987 | Yang |
| 4,703,673 | A | 11/1987 | Allen |
| 4,711,353 | A | 12/1987 | Rozmestor |
| 4,716,795 | A | 1/1988 | Corona et al. |
| 4,716,796 | A | 1/1988 | Corona et al. |
| 4,767,006 | A | 8/1988 | Wasem |
| 4,783,867 | A | 11/1988 | Tsao |
| 4,787,276 | A | 11/1988 | Condon |
| 4,815,346 | A | 3/1989 | Littlehorn |
| 4,819,523 | A | 4/1989 | Souza |
| 4,819,800 | A | 4/1989 | Wilson |
| 4,820,090 | A | 4/1989 | Chen |
| D302,102 | S | 7/1989 | Amagaya |
| 4,882,841 | A | 11/1989 | Margolis |
| 4,922,569 | A | 5/1990 | Brinker et al. |
| 4,926,721 | A | 5/1990 | Hsiao |
| D308,462 | S | 6/1990 | Komatsu |
| 4,934,223 | A | 6/1990 | Wong |
| D310,770 | S | 9/1990 | Zamarripa |
| D311,124 | S | 10/1990 | Leamey |
| 4,960,016 | A | 10/1990 | Seals |
| 4,974,477 | A | 12/1990 | Anderson |
| 4,979,407 | A | 12/1990 | Hernandez et al. |
| 5,029,707 | A | 7/1991 | Feng |
| 5,036,975 | A | 8/1991 | Chow |
| 5,042,658 | A | 8/1991 | Tiramani et al. |
| 5,062,173 | A | 11/1991 | Collins et al. |
| 5,063,796 | A | 11/1991 | Gennep |
| 5,065,487 | A | 11/1991 | Yother |
| 5,086,674 | A | 2/1992 | Her |
| 5,146,815 | A | 9/1992 | Scott, III |
| 5,147,038 | A | 9/1992 | Pergeau |
| D333,769 | S | 3/1993 | Jureckson |
| D334,516 | S | 4/1993 | Tsunoda |
| D339,048 | S | 9/1993 | Baum |
| 5,251,352 | A | 10/1993 | Cullison |
| 5,263,389 | A | 11/1993 | Frazell et al. |
| 5,265,504 | A | 11/1993 | Fruhm |

(56) References Cited

U.S. PATENT DOCUMENTS

| | | | |
|---|---|---|---|
| D342,433 | S | 12/1993 | Sorenson |
| 5,271,300 | A | 12/1993 | Zurbuchen et al. |
| D343,106 | S | 1/1994 | Eklind et al. |
| 5,295,422 | A | 3/1994 | Chow |
| 5,320,004 | A | 6/1994 | Hsiao |
| 5,329,834 | A | 7/1994 | Wong |
| 5,394,984 | A | 3/1995 | Aiba |
| 5,416,940 | A | 5/1995 | Bandera |
| D359,671 | S | 6/1995 | Acosta |
| 5,421,225 | A | 6/1995 | Chen |
| 5,450,774 | A | 9/1995 | Chang |
| 5,450,775 | A | 9/1995 | Kozak |
| 5,461,950 | A | 10/1995 | Iwinski |
| D365,681 | S | 1/1996 | Chow |
| 5,495,942 | A | 3/1996 | Ishak |
| 5,499,560 | A | 3/1996 | Aeschliman |
| 5,499,562 | A | 3/1996 | Feng |
| 5,505,316 | A | 4/1996 | Lee |
| 5,515,969 | A | 5/1996 | Schonenbach |
| 5,517,885 | A | 5/1996 | Feng |
| 5,480,166 | A | 6/1996 | Milsop |
| 5,522,291 | A | 6/1996 | Liu |
| 5,535,882 | A | 7/1996 | Liu |
| 5,542,322 | A | 8/1996 | Knox et al. |
| D373,943 | S | 9/1996 | Fuhrmann |
| 5,553,340 | A | 9/1996 | Brown, Jr. |
| 5,566,596 | A | 10/1996 | Lin |
| D376,520 | S | 12/1996 | Morin |
| 5,581,834 | A | 12/1996 | Collins |
| D377,444 | S | 1/1997 | Lin |
| 5,592,859 | A | 1/1997 | Johnson et al. |
| D378,797 | S | 4/1997 | Poremba et al. |
| 5,630,342 | A | 5/1997 | Owoc |
| D380,131 | S | 6/1997 | Sung |
| D382,190 | S | 8/1997 | Blackston et al. |
| 5,653,525 | A | 8/1997 | Park |
| D383,048 | S | 9/1997 | Sorenson et al. |
| 5,662,013 | A | 9/1997 | Lin |
| D385,172 | S | 10/1997 | Bramsiepe et al. |
| D386,955 | S | 12/1997 | Jones et al. |
| 5,692,656 | A | 12/1997 | Dembicks |
| D388,609 | S | 1/1998 | Chan |
| 5,711,042 | A | 1/1998 | Chuang |
| 5,711,194 | A | 1/1998 | Anderson et al. |
| D394,792 | S | 6/1998 | Bourque |
| D394,794 | S | 6/1998 | Vasudeva |
| 5,758,870 | A | 6/1998 | Weaver |
| 5,765,247 | A | 6/1998 | Seber |
| 5,765,454 | A | 6/1998 | Barbulescu et al. |
| 5,768,960 | A | 6/1998 | Archuleta |
| 5,791,211 | A | 8/1998 | Bondhus et al. |
| 5,802,936 | A | 9/1998 | Liu |
| 5,803,584 | A | 9/1998 | Chung |
| 5,816,401 | A | 10/1998 | Vasudeva et al. |
| 5,820,288 | A | 10/1998 | Cole |
| 5,822,830 | A | 10/1998 | Lin |
| D400,775 | S | 11/1998 | Hsu |
| 5,855,274 | A | 1/1999 | Piao |
| D405,335 | S | 2/1999 | Lin |
| 5,911,799 | A | 6/1999 | Johnson et al. |
| 5,916,277 | A | 6/1999 | Dallas |
| 5,916,341 | A | 6/1999 | Lin |
| 5,918,513 | A | 7/1999 | Ho |
| 5,918,741 | A | 7/1999 | Vasudeva |
| 5,938,028 | A | 8/1999 | Hu |
| 5,970,828 | A | 10/1999 | Bondhus et al. |
| D415,946 | S | 11/1999 | Tsai |
| 5,983,759 | A | 11/1999 | Turner |
| 5,992,626 | A | 11/1999 | Anderson |
| D420,885 | S | 2/2000 | Lin |
| 6,032,332 | A | 3/2000 | Lin |
| 6,032,796 | A | 3/2000 | Hopper et al. |
| 6,044,973 | A | 4/2000 | Vasudeva |
| 6,050,409 | A | 4/2000 | Delbeck |
| D426,449 | S | 6/2000 | Eklind |
| D426,450 | S | 6/2000 | Eklind |
| D427,875 | S | 7/2000 | Chiu |
| 6,085,620 | A | 7/2000 | Anderson et al. |
| 6,088,861 | A | 7/2000 | Sessions et al. |
| 6,089,133 | A | 7/2000 | Liao |
| 6,092,656 | A | 7/2000 | Ernst |
| 6,095,018 | A | 8/2000 | Schuster |
| 6,105,767 | A | 8/2000 | Vasudeva |
| 6,119,560 | A | 9/2000 | Anderson et al. |
| 6,128,981 | A | 10/2000 | Bondhus et al. |
| 6,131,740 | A | 10/2000 | Huang |
| D433,613 | S | 11/2000 | Jallin |
| D433,910 | S | 11/2000 | Oliver et al. |
| 6,151,998 | A | 11/2000 | Fu-Hui |
| D435,415 | S | 12/2000 | Johnson et al. |
| 6,164,172 | A | 12/2000 | Huang |
| D435,773 | S | 1/2001 | Lin |
| D437,541 | S | 2/2001 | Hermansen et al. |
| D437,763 | S | 2/2001 | Oliver et al. |
| 6,186,785 | B1 | 2/2001 | Rogers et al. |
| 6,202,864 | B1 | 3/2001 | Ernst et al. |
| 6,206,189 | B1 | 3/2001 | Huot, Jr. et al. |
| D440,852 | S | 4/2001 | Ernst |
| 6,233,769 | B1 | 5/2001 | Seber et al. |
| 6,237,451 | B1 | 5/2001 | Wei |
| 6,257,106 | B1 | 7/2001 | Anderson et al. |
| 6,260,453 | B1 | 7/2001 | Anderson et al. |
| 6,279,434 | B1 | 8/2001 | Brown |
| 6,279,435 | B1 | 8/2001 | Zayat, Jr. |
| D448,267 | S | 9/2001 | Jean et al. |
| 6,289,768 | B1 | 9/2001 | Anderson et al. |
| 6,308,599 | B1 | 10/2001 | Fu-Hui |
| 6,311,587 | B1 | 11/2001 | Johnson et al. |
| 6,314,600 | B1 | 11/2001 | Cachot |
| 6,314,838 | B2 | 11/2001 | Wall |
| 6,318,218 | B1 | 11/2001 | Anderson et al. |
| 6,332,381 | B1 | 12/2001 | Vasudeva |
| 6,345,557 | B1 | 2/2002 | Kuo |
| D454,766 | S | 3/2002 | Lin |
| 6,352,010 | B1 | 3/2002 | Giarritta et al. |
| 6,357,068 | B1 | 3/2002 | Seber et al. |
| D455,630 | S | 4/2002 | Chiu |
| 6,371,290 | B1 | 4/2002 | Yearous et al. |
| 6,378,402 | B1 | 4/2002 | Kalomeris et al. |
| 6,382,057 | B1 | 5/2002 | Kienholz |
| 6,389,931 | B1 | 5/2002 | Delaney et al. |
| 6,397,709 | B1 | 6/2002 | Wall |
| 6,401,576 | B1 | 6/2002 | Wu |
| 6,401,923 | B1 | 6/2002 | Huang |
| 6,405,620 | B2 | 6/2002 | Liao |
| D459,967 | S | 7/2002 | Johnson et al. |
| D461,311 | S | 8/2002 | Gharib |
| D462,002 | S | 8/2002 | Jean et al. |
| 6,427,564 | B1 | 8/2002 | Nelson |
| 6,490,954 | B2 | 12/2002 | Johnson et al. |
| 6,510,766 | B1 | 1/2003 | Lin |
| 6,510,767 | B1 | 1/2003 | Rivera |
| D470,739 | S | 2/2003 | Chen |
| D472,712 | S | 4/2003 | Sagen |
| D472,931 | S | 4/2003 | Leins |
| 6,564,680 | B1 | 5/2003 | Rinner et al. |
| 6,598,503 | B1 | 7/2003 | Cunningham |
| 6,601,481 | B2 | 8/2003 | Chuang |
| 6,606,925 | B1 | 8/2003 | Gmeilbauer |
| D479,963 | S | 9/2003 | Chang |
| 6,634,502 | B1 | 10/2003 | Yu |
| 6,640,675 | B1 | 11/2003 | Chuang |
| 6,675,678 | B2 | 1/2004 | Liu |
| 6,698,318 | B2 | 3/2004 | Peters |
| 6,701,813 | B2 | 3/2004 | Hu |
| 6,709,196 | B1 | 3/2004 | Medendorp |
| 6,739,224 | B1 | 5/2004 | Wershe |
| 6,751,819 | B2 | 6/2004 | Chuang |
| 6,751,820 | B1 | 6/2004 | Wu |
| 6,752,046 | B1 | 6/2004 | Lee |
| 6,758,350 | B2 | 7/2004 | Lin |
| 6,763,744 | B2 | 7/2004 | Johnson et al. |
| D494,438 | S | 8/2004 | Flakenstein et al. |
| 6,799,490 | B1 | 10/2004 | Chu |

(56) References Cited

U.S. PATENT DOCUMENTS

| | | | |
|---|---|---|---|
| 6,827,210 | B2 | 12/2004 | Chen |
| 6,863,471 | B2 | 3/2005 | Medendorp |
| 6,877,186 | B2 | 4/2005 | Shiao |
| 6,896,136 | B2 | 5/2005 | Hu |
| 6,898,998 | B2 | 5/2005 | Shyu |
| 6,901,826 | B2 | 6/2005 | Huang |
| 6,918,323 | B2 | 7/2005 | Arnold et al. |
| 6,922,870 | B2 | 8/2005 | Tontz, Sr. |
| 6,925,910 | B2 | 8/2005 | Alford |
| 6,928,908 | B1 | 8/2005 | Yu |
| 6,935,211 | B2 | 8/2005 | Chen |
| 6,935,212 | B2 | 8/2005 | Wadsworth |
| 6,941,843 | B2 | 9/2005 | Johnson et al. |
| 6,948,406 | B1 | 9/2005 | Li |
| 6,968,758 | B2 | 11/2005 | Lin |
| 6,988,616 | B2 | 1/2006 | Chen |
| D517,391 | S | 3/2006 | Leins |
| 7,028,593 | B1 | 4/2006 | Lin et al. |
| 7,047,847 | B2 | 5/2006 | Chuang |
| 7,051,626 | B1 | 5/2006 | Chen |
| 7,051,629 | B2 | 5/2006 | Huang |
| D523,637 | S | 6/2006 | Chang |
| 7,073,418 | B2 | 7/2006 | Kuo |
| 7,080,582 | B2 | 7/2006 | Karle |
| 7,086,314 | B2 | 8/2006 | Wannop |
| 7,093,519 | B1 | 8/2006 | Huang |
| D527,903 | S | 9/2006 | Chan |
| 7,100,476 | B1 | 9/2006 | Feit |
| 7,131,358 | B2 | 11/2006 | Hsien |
| 7,140,280 | B2 | 11/2006 | Hawkins et al. |
| 7,143,669 | B2 | 12/2006 | Hu |
| 7,150,208 | B2 | 12/2006 | Debley |
| 7,155,998 | B1 | 1/2007 | Shyu |
| 7,159,260 | B2 | 1/2007 | Hansen |
| 7,159,491 | B1 | 1/2007 | Chaconas et al. |
| 7,165,479 | B1 | 1/2007 | Lee |
| 7,168,345 | B1 | 1/2007 | Hsieh |
| 7,182,003 | B1 | 2/2007 | Hsieh |
| 7,185,565 | B1 | 3/2007 | Hu |
| 7,216,569 | B2 | 5/2007 | Abdelgany |
| 7,237,463 | B1 | 7/2007 | Lee |
| D548,464 | S | 8/2007 | Lin |
| D549,069 | S | 8/2007 | Lin et al. |
| 7,281,454 | B2 | 10/2007 | Johnson et al. |
| 7,284,466 | B1 | 10/2007 | Ho |
| 7,287,450 | B1 | 10/2007 | Liao |
| D557,099 | S | 12/2007 | Lin |
| 7,305,908 | B2 | 12/2007 | Chi |
| 7,406,896 | B2 | 8/2008 | Rivera |
| 7,409,894 | B1 | 8/2008 | Valentine |
| 7,415,745 | B2 | 8/2008 | Rivera |
| 7,467,574 | B1 | 12/2008 | Lin |
| 7,467,575 | B2 | 12/2008 | Lai |
| 7,565,852 | B2 | 7/2009 | Yu |
| 7,571,517 | B2 | 8/2009 | Smith et al. |
| 7,600,640 | B2 | 10/2009 | Hallee et al. |
| D604,509 | S | 11/2009 | Andrews |
| 7,698,972 | B2 | 4/2010 | Hi |
| 7,743,685 | B2 | 6/2010 | Chang |
| D622,125 | S | 8/2010 | Robinson |
| D623,037 | S | 9/2010 | Johnson et al. |
| 7,788,996 | B2 | 9/2010 | Johnson et al. |
| 7,810,415 | B2 | 10/2010 | Adamany et al. |
| 7,815,058 | B2 | 10/2010 | Cheng |
| 7,836,534 | B2 | 11/2010 | Simmons |
| 7,846,203 | B2 | 12/2010 | Cribier |
| 7,946,203 | B2 | 5/2011 | Johnson et al. |
| 8,011,277 | B2 | 9/2011 | Johnso et al. |
| 8,015,642 | B1 | 9/2011 | Oakley |
| 8,033,200 | B2 | 10/2011 | Johnson et al. |
| D650,257 | S | 12/2011 | Royes et al. |
| 8,336,428 | B2 | 12/2012 | Johnson et al. |
| 8,359,954 | B2 | 1/2013 | Johnson et al. |
| 8,468,916 | B2 | 6/2013 | Johnson et al. |
| 8,613,121 | B1 | 12/2013 | White |
| 8,621,963 | B2 | 1/2014 | Johnson et al. |
| 8,640,574 | B2 | 2/2014 | Johnson et al. |
| 8,875,601 | B2 | 11/2014 | Johnson et al. |
| 8,925,429 | B2 | 1/2015 | Johnson et al. |
| 9,144,801 | B2 | 9/2015 | Johnson |
| 2001/0005576 | A1 | 6/2001 | Roger et al. |
| 2001/0045145 | A1 | 11/2001 | Legg |
| 2003/0000902 | A1 | 1/2003 | Keis et al. |
| 2003/0047474 | A1 | 3/2003 | Dahlson |
| 2003/0126957 | A1 | 7/2003 | Huang |
| 2003/0136234 | A1 | 7/2003 | Cunningham |
| 2003/0188610 | A1 | 10/2003 | Lin |
| 2003/0226428 | A1 | 12/2003 | Liu |
| 2004/0050218 | A1 | 3/2004 | Napoli |
| 2004/0079622 | A1 | 4/2004 | Wang |
| 2004/0173061 | A1 | 9/2004 | Liou |
| 2004/0262344 | A1 | 12/2004 | White |
| 2005/0011318 | A1 | 1/2005 | Tsai |
| 2005/0199108 | A1 | 9/2005 | Jheng |
| 2005/0229752 | A1 | 10/2005 | Nickipuck |
| 2005/0247587 | A1 | 11/2005 | Holland-Letz |
| 2005/0268752 | A1 | 12/2005 | Johnson et al. |
| 2005/0268754 | A1 | 12/2005 | Fa |
| 2005/0284267 | A1 | 12/2005 | Liao et al. |
| 2006/0042428 | A1 | 3/2006 | Chuang |
| 2006/0101955 | A1 | 5/2006 | Chang |
| 2006/0118500 | A1 | 6/2006 | Chen |
| 2006/0150784 | A1 | 7/2006 | Hsieh |
| 2006/0213059 | A1 | 9/2006 | Eggert |
| 2006/0254396 | A1 | 11/2006 | Hu |
| 2006/0288531 | A1 | 12/2006 | Hu |
| 2006/0288823 | A1 | 12/2006 | Schepman |
| 2007/0007222 | A1 | 1/2007 | Kao |
| 2007/0023306 | A1 | 2/2007 | Lai |
| 2007/0044598 | A1 | 3/2007 | Frohm et al. |
| 2007/0056117 | A1 | 3/2007 | Gardiner et al. |
| 2007/0056872 | A1 | 3/2007 | Begim |
| 2007/0062831 | A1 | 3/2007 | Chen |
| 2007/0084740 | A1 | 4/2007 | Malek |
| 2007/0141885 | A1 | 6/2007 | Chen |
| 2007/0151402 | A1 | 7/2007 | Schneerman et al. |
| 2007/0186731 | A1 | 8/2007 | Schnarr et al. |
| 2007/0221017 | A1 | 9/2007 | Heaven |
| 2007/0228672 | A1 | 10/2007 | Huang |
| 2007/0235360 | A1 | 10/2007 | Lin |
| 2007/0245862 | A1 | 10/2007 | Gonzalez et al. |
| 2007/0295171 | A1 | 12/2007 | Johnson et al. |
| 2008/0011634 | A1 | 1/2008 | Lin |
| 2008/0128370 | A1 | 6/2008 | Shih |
| 2008/0148909 | A1 | 6/2008 | Lai |
| 2008/0156754 | A1 | 7/2008 | Cheng |
| 2008/0164171 | A1 | 7/2008 | Meng |
| 2008/0190249 | A1 | 8/2008 | Yu |
| 2008/0202963 | A1 | 8/2008 | Liao |
| 2008/0223179 | A1 | 9/2008 | Nash et al. |
| 2008/0251402 | A1 | 10/2008 | Chiu |
| 2008/0256816 | A1 | 10/2008 | Consentino |
| 2008/0271573 | A1 | 11/2008 | Lown et al. |
| 2008/0295657 | A1 | 12/2008 | Cluthe |
| 2009/0107303 | A1 | 4/2009 | Steinweg et al. |
| 2009/0183604 | A1 | 7/2009 | Johnson et al. |
| 2009/0183608 | A1 | 7/2009 | Johnson et al. |
| 2009/0183609 | A1 | 7/2009 | Johnson et al. |
| 2009/0241740 | A1 | 10/2009 | Heagerty |
| 2010/0258465 | A1 | 10/2010 | Gomas |
| 2011/0000024 | A1 | 1/2011 | Johnson et al. |
| 2011/0094910 | A1 | 4/2011 | Fleury et al. |
| 2012/0012485 | A1 | 1/2012 | Wang |
| 2013/0112635 | A1 | 5/2013 | Tsukaguchi |
| 2013/0228484 | A1 | 9/2013 | Yang |
| 2013/0228539 | A1 | 9/2013 | Lin |
| 2013/0256168 | A1 | 10/2013 | Poillot |

FOREIGN PATENT DOCUMENTS

| | | |
|---|---|---|
| CN | 2628230 Y | 7/2004 |
| DE | 464002 | 8/1928 |
| DE | 2035793 B1 | 3/1972 |
| DE | 2453480 A1 | 5/1976 |

(56) References Cited

FOREIGN PATENT DOCUMENTS

| | | | |
|---|---|---|---|
| DE | 3744176 | A1 | 8/1988 |
| DE | 102004011892 | A1 | 1/2005 |
| DE | 202004013404 | U1 | 3/2005 |
| DE | 20 2007 003841 | U1 | 9/2007 |
| EP | 856223 | | 12/1960 |
| EP | 503559 | A1 | 9/1992 |
| EP | 618046 | A1 | 10/1994 |
| EP | 01693163 | A2 | 2/2006 |
| EP | 01777042 | A1 | 4/2007 |
| FR | 787512 | | 9/1935 |
| JP | 55045442 | U | 3/1980 |
| JP | 57-13165 | A | 1/1982 |
| JP | 61136778 | | 6/1986 |
| JP | 3-47775 | | 5/1991 |
| JP | 03103162 | | 10/1991 |
| JP | 4-29368 | | 3/1992 |
| JP | 5-31882 | | 4/1993 |
| JP | 08508512 | | 6/1996 |
| TW | I236402 | | 7/2005 |
| TW | M284496 | | 1/2006 |
| TW | M284500 | | 1/2006 |
| TW | M296765 | | 9/2006 |
| TW | I270445 | | 1/2007 |
| WO | 83/01406 | A1 | 4/1983 |
| WO | 9412322 | A1 | 6/1994 |
| WO | 199623631 | A1 | 8/1996 |
| WO | 97/29887 | A1 | 8/1997 |

300

400

ADJUSTABLE TOOL HANDLE FOR HOLDING A TOOL DURING USE

RELATED APPLICATIONS

This application is a divisional of co-pending U.S. patent application Ser. No. 13/472,350, filed on May 15, 2012 and entitled "ADJUSTABLE TOOL HANDLE FOR HOLDING A TOOL DURING USE," which is hereby incorporated by reference.

FIELD OF THE INVENTION

The present invention relates to the field of hand held tools. More specifically, the present invention relates to the field of hexagonal wrenches and related tools and safety, comfort, and convenience of accessories and tools.

BACKGROUND OF THE INVENTION

Hexagonal wrenches or tool drivers, also referred to as allen wrenches or L-wrenches, have a hexagonal L-shaped body, including a long leg member and a short leg member. The end of either leg member is able to be inserted into a head of a screw or tool designed to accept a hexagonal wrench. Once inserted, rotational pressure is applied to the hexagonal wrench in order to tighten or loosen the screw. The leg members of the hexagonal wrench are designed to be of different lengths in order to allow a user flexibility when using the wrench in different environments and situations. For example, in a narrow, confined environment, the long leg of the hexagonal wrench is inserted into the head of the screw and the user will apply rotational pressure to the short leg. Or, if the environment is not so confined, the user is able to insert the short leg of the hexagonal wrench into the head of the screw and apply rotational pressure to the long leg.

Hexagonal wrenches are manufactured and distributed in multiple English and metric sizes in order to facilitate their use with screw heads of multiple sizes. Such wrenches are usually sold in a set which includes wrenches of multiple sizes but are also distributed individually.

When using a hexagonal wrench, a user, will insert an end of the hexagonal wrench into the head of a workpiece such as a screw, and will then exert rotational pressure on the opposite end of the wrench in order to tighten or loosen the screw. Because of the size and dimensions of the hexagonal wrench it is particularly difficult to exert a great amount of rotational pressure on the hexagonal wrench when the long leg of the hexagonal wrench is inserted into the head of the screw. Because the hexagonal wrench is typically turned with the user's fingers, the user is able to also experience scrapes and cuts from the use of hexagonal wrenches in this manner. Ingenuitive users have also used other tools, including vice grips, pliers and the like, to turn hexagonal wrenches. However, this method is disadvantageous because such tools are able to lose their hold on the hexagonal wrench when rotational pressure is applied or are able to even bend or otherwise disfigure the hexagonal wrench.

SUMMARY OF THE INVENTION

An adjustable tool handle for holding a tool during use provides an improved handling of tools during use of tools that are difficult to use on their own, specifically L-shaped hexagonal wrenches. The adjustable tool handle includes a tool handle body with a handle and an adjustable opening for receiving a tool. In order to place a tool within the tool handle, a user opens the tool handle. When the tool handle is open, one leg of the tool handle is inserted into one of a plurality of openings on the back of the body and the other leg is placed within the adjustable opening. After the tool is placed within the tool handle, the tool is held in place by a securing mechanism. With the tool coupled to the tool handle, a user is able to tighten and loosen work pieces of different sizes and different types.

In one aspect, a tool handle for holding a tool during use comprises a body having a first end and a second end, a first adjustable opening for receiving one of a plurality of tools of different sizes and one or more second openings for also receiving the tool, wherein an operable end of the tool extends from the first end or the side of the tool handle during use. In some embodiments, the second end comprises an ergonomically shaped handle portion for holding during use. In some embodiments, the tool is a hexagonal shaped tool or a round shaped tool having an L-shaped body including a long leg member and a short leg member. In further embodiments, the first adjustable opening and the one or more second openings are positioned on sides at 90 degrees of one another. In some of these embodiments, each of the first adjustable opening and the one or more second openings receive the long leg member or the short leg member of the tool. In further embodiments, the long leg member of the tool extends from the first end of the body and the short leg member of the tool extends from a side of the body. In some embodiments, the tool handle further comprises a securing member which secures the tool within the body. In some embodiments, the securing member pushes the tool into a bottom of the adjustable opening in order to secure the tool within the tool holder. In some embodiments, the securing member is slid to a closed position in order to secure the tool within the handle. In further embodiments, the securing member is rotated to a closed position in order to secure the tool within the handle. In some embodiments, the tool handle further comprises a lock for locking the tool within the tool handle.

In another aspect, a tool handle for holding a tool during use comprises a body having a first end and a second end, a first adjustable opening for receiving one of a plurality of tools of different sizes, and a plurality of second openings each for receiving the tool wherein the first adjustable opening and the plurality of second openings are positioned on sides at 90 degrees of one another. In some embodiments, the second end comprises an ergonomically shaped handle portion for holding during use. In some embodiments, the tool is a hexagonal shaped tool or a round shaped tool having an L-shaped body including a long leg member and a short leg member. In some of these embodiments, each of the first adjustable opening and one of the plurality of second openings receive the long leg member or the short leg member of the tool. In further embodiments, the long leg member of the tool extends from the first end of the body and the short leg member of the tool extends from a side of the body. In some embodiments, the tool handle further comprises a securing member which secures the tool within the body. In some embodiments, the securing member pushes the tool into a bottom of the adjustable opening in order to secure the tool within the tool holder. In some embodiments, the securing member is slid to a closed position in order to secure the tool within the handle. In further embodiments, the securing member is rotated to a closed position in order to secure the tool within the handle. In some embodiments, the tool handle further comprises a lock for locking the tool within the tool handle.

In a further aspect, a method of utilizing an adjustable tool handle for holding a plurality of different sized tools comprises moving a securing member to an open position, placing one leg of a tool within a first adjustable opening and a second leg of the tool within a second opening and moving a securing mechanism to a closed position and securing the tool within the tool handle, wherein the first adjustable opening and the plurality of second openings are positioned on sides at 90 degrees of one another. In some embodiments, the securing member is slid to a closed position in order to secure the tool within the handle. In further embodiments, the securing member is rotated to a closed position in order to secure the tool within the handle. In some embodiments, the method further comprises locking the tool within the tool handle.

In still a further aspect, a tool set comprises a tool set comprises a tool handle for removably holding one of a plurality of sized tools during use, and a ratcheting mechanism that detachably couples to the tool handle, and extends from a first end or a side of the tool handle during use, and wherein the ratcheting mechanism separately holds one of a plurality of bits or sockets during use. In some embodiments, the tool handle comprises a body having a first end and a second end, a first adjustable opening for receiving one of a plurality of tools of different sizes, and one or more second openings for also receiving the tool wherein an operable end of the tool extends from the first end or the side of the tool handle during use. In some embodiments, the one of a plurality of tools is a hexagonal shaped tool or a round shaped tool having an L-shaped body including a long leg member and a short leg member. In further embodiments, the securing mechanism is manually moved from a closed position to an open position in order to place the tool within the adjustable opening and is manually returned to the closed position in order to hold the tool within the opening. In some embodiments, the ratcheting mechanism removably couples to the first end of the handle. In further embodiments, the ratcheting mechanism removably couples to a side of the handle. In some embodiments, the ratcheting mechanism removably receives one of a plurality of bits or sockets, each sized to fit a different sized work piece. In further embodiments, the ratcheting mechanism removably receives one or more of a hexagonal bit, a flathead bit, a phillips head bit, a square head bit, a star head bit, and other shaped bits. In some embodiments, the tool handle comprises a lock. In some embodiments, the ratcheting mechanism removably couples with the tool.

DETAILED DESCRIPTION OF THE PREFERRED EMBODIMENT

Figure 1:
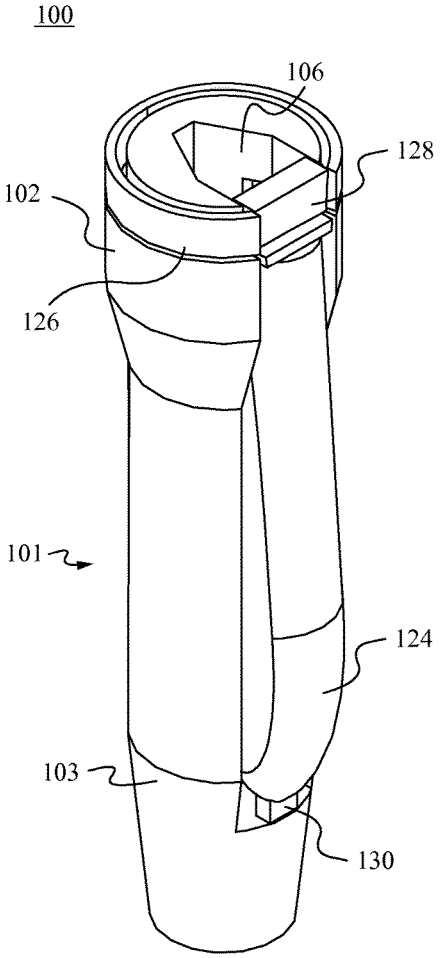
FIG. 1 illustrates a side perspective view of an adjustable tool handle for holding a tool during use in accordance with some embodiments.

FIG. 1 illustrates a side perspective view of an adjustable tool handle for holding a tool during use in accordance with further embodiments. The tool handle 100 comprises a tool handle body 101 having a first end 102 and a second end 103, an opening 106, a securing mechanism 124, and a lock 126. As shown in FIG. 1, the opening 106 comprises a rectangular shaped opening with a v-shaped bottom to the channel. In some embodiments, the opening 106 and the tool handle 100 are configured for holding a L-shaped hexagonal tool. However, the channel is able to be any appropriate shape in the art and compatible with holding a tool. As described further below, the securing mechanism 124 is openable. In some embodiments, the securing mechanism 124 is opened by pulling the securing mechanism 124 away from the body 101 and rotating the securing mechanism about the bottom portion 130. When the securing mechanism 124 is opened, the opening 106 is able to be accessed and a tool is able to be removably coupled with the tool handle 100. In some embodiments, the second end 103 of the tool handle 100 is ergonomically shaped so as to comfortably fit into the hand of a user. In some embodiments, the second end 103 of the tool handle 100 is rubber and/or texturized in order to enable a user to easily grip the handle 100.

Figure 2:
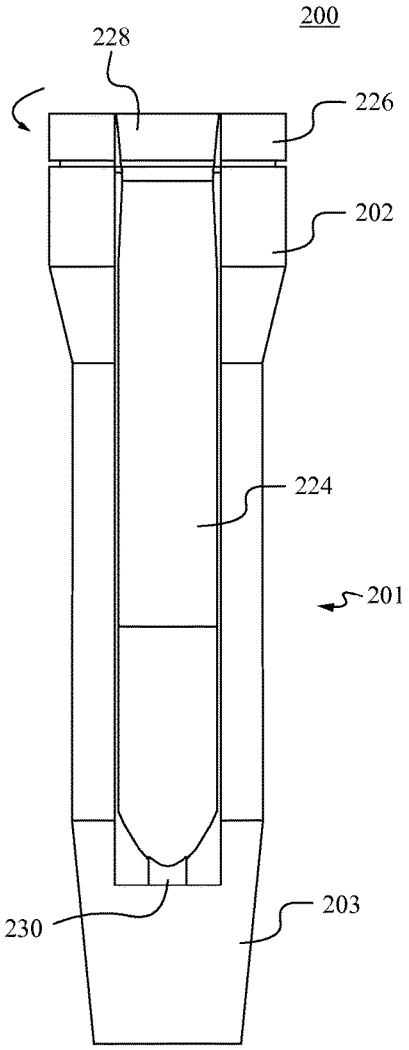
FIG. 2 illustrates a front view of an adjustable tool handle for holding a tool during use in accordance with some embodiments.

FIG. 2 illustrates a front view of an adjustable tool handle for holding a tool during use in accordance with some embodiments. The tool handle 200 comprises a tool handle body 201 having a first end 202 and a second end 203, an opening 206, a securing mechanism 224, and a lock 226. As shown in FIG. 2, when the securing mechanism 224 is in a closed position, the opening is blocked. In some embodiments, the securing mechanism 224 is locked in a closed position by twisting the lock 226 in order to cover a top portion 228 of the securing mechanism 224. The lock 226 is twisted in the opposite direction in order to uncover the top portion 228 and open the securing mechanism 224 in order to removably couple a tool with the tool handle 200.

Figure 3:
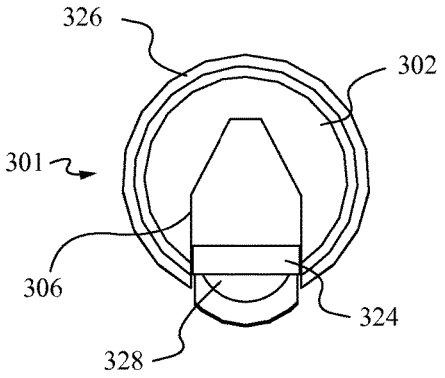
FIG. 3 illustrates a top view of an adjustable tool handle for holding a tool during use in accordance with some embodiments.

FIG. 3 illustrates a top view of an adjustable tool handle for holding a tool during use in accordance with some embodiments. The tool handle 300 comprises a body having a first end 302, an opening 306, a securing mechanism 324, and a lock 326. As shown in the top view, when the lock 326 is in an unlocked position, the top of the securing mechanism 328 is able to travel through an open space of the lock 326.

Figure 4:
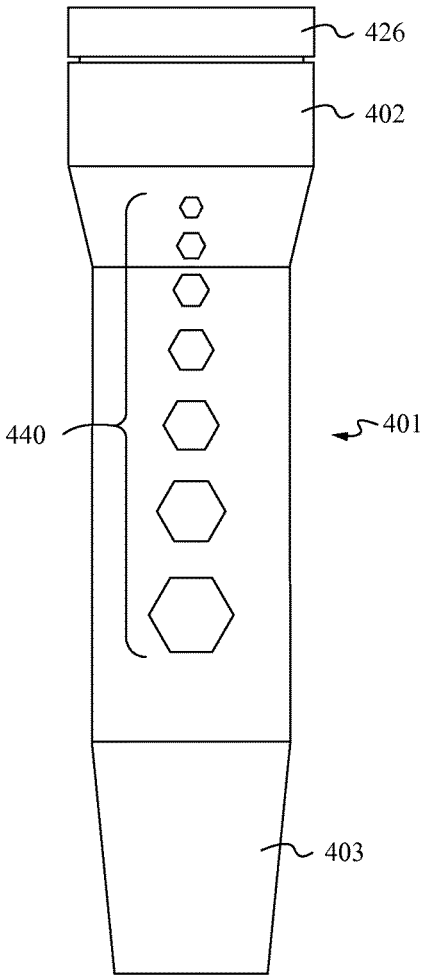
FIG. 4 illustrates a back view of an adjustable tool handle for holding a tool during use in accordance with some embodiments.

FIG. 4 illustrates a back view of the adjustable tool handle for holding a tool during use. The back view shows a tool handle 400 comprising a body 401 having a first end 402 and a second end 403, a lock 426, and one or more apertures 440. As shown in FIG. 4, the one or more apertures 440 are grouped in ascending order according to size. However, the one or more apertures 440 are able to be grouped in any desired configuration. In some embodiments, the one or more apertures 440 are hexagonally shaped. In some embodiments, a portion of a tool is inserted through one of the one or more apertures 440 when the tool is removably coupled with the tool handle 400.

Figure 5:
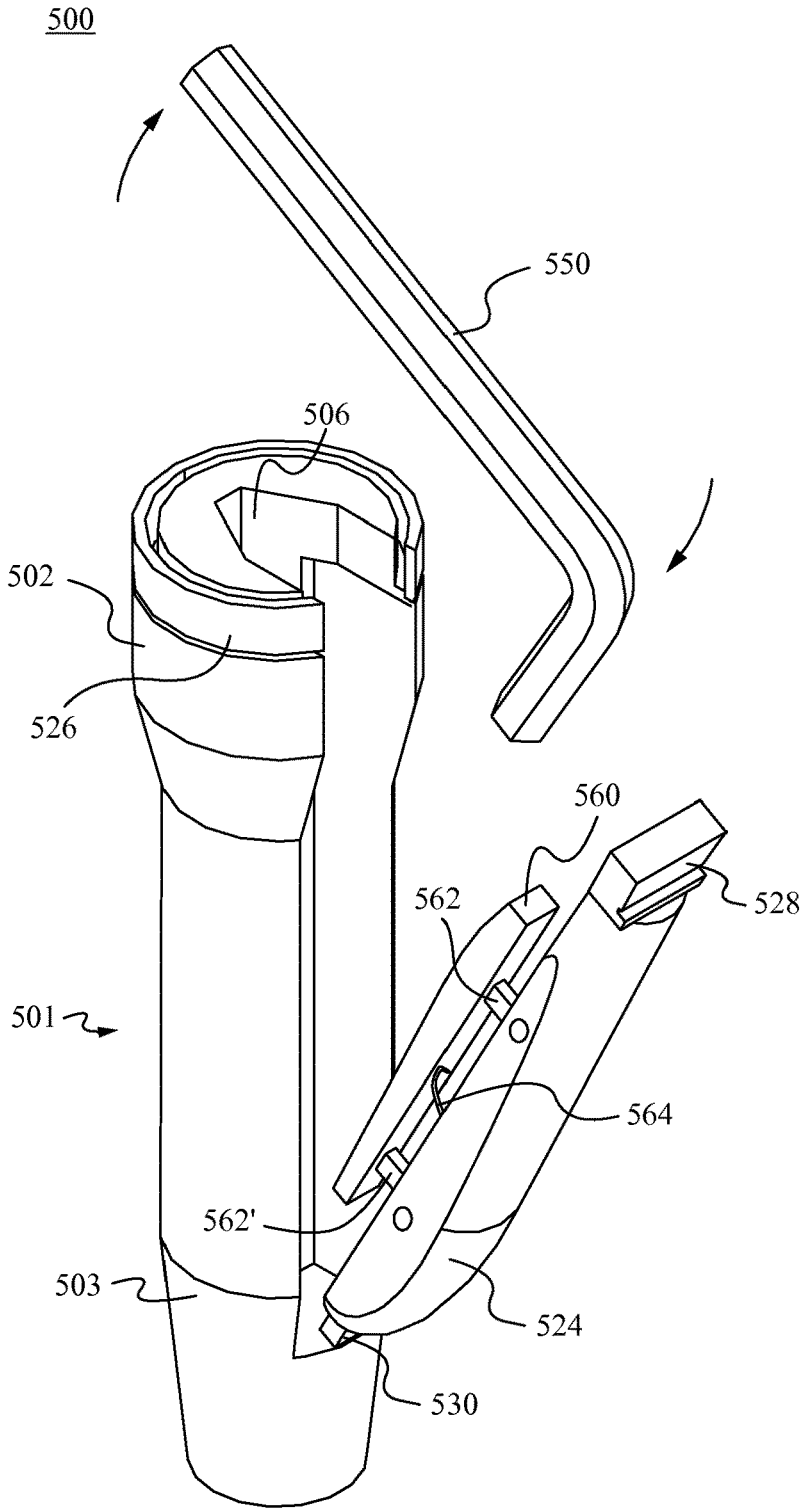
FIG. 5 illustrates a tool being coupled with an adjustable tool handle for holding a tool during use in accordance with some embodiments.

FIG. 5 illustrates a tool being coupled with an adjustable tool handle in accordance with some embodiments. The tool handle 500 comprises a tool handle body 501 having a first end 502 and a second end 503, an opening 506, a securing mechanism 524, and a lock 526. The securing mechanism 524 is shown in an open position. As shown in FIG. 5, the securing mechanism 524 comprises an adjustment component 560. The adjustment component 560 is coupled to the securing mechanism 524 by one or more bars 562 and 562' and a spring 564. The adjustment component 560 is configured to lay flat against the securing mechanism 524 when a force is applied to the adjustment component 560.

Figure 6A:
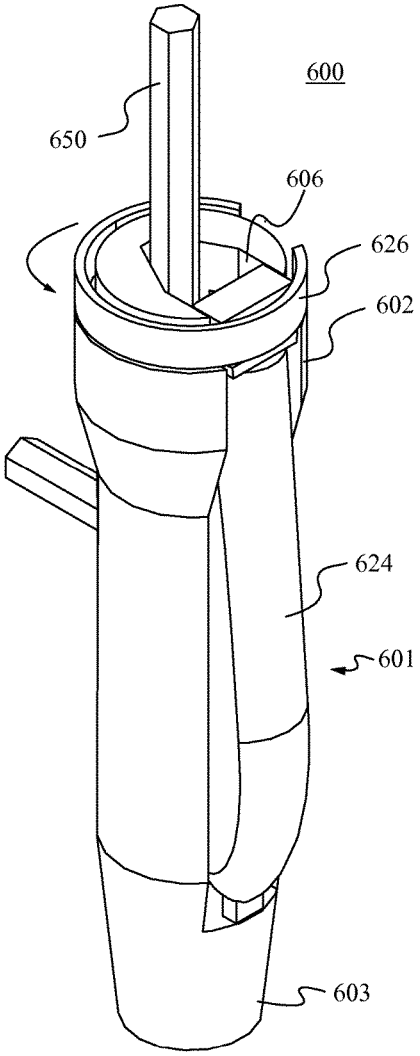
FIGS. 6A and 6B illustrate a tool coupled with an adjustable tool handle for holding a tool during use in accordance with some embodiments.

As further shown within FIG. 5, in some embodiments, in order to position a tool 550 within the tool handle 500 the short leg of a L-shaped hexagonal tool is inserted into the opening 506. After the short leg is inserted into the opening 506, the tool 550 is turned and the short leg is inserted into and through one of the one or more apertures of the back side of the body 501. Once the short leg has been inserted through one of the one or more apertures the securing mechanism 524 is moved to the closed position in order to confine the tool 550 within the tool handle 600. As shown within FIG. 6A when the tool 650 is positioned so that it extends from the first end of the tool handle 600, the short leg of the tool 650 extends through one of the one or more apertures and from the back side of the tool handle.

Figure 6B:
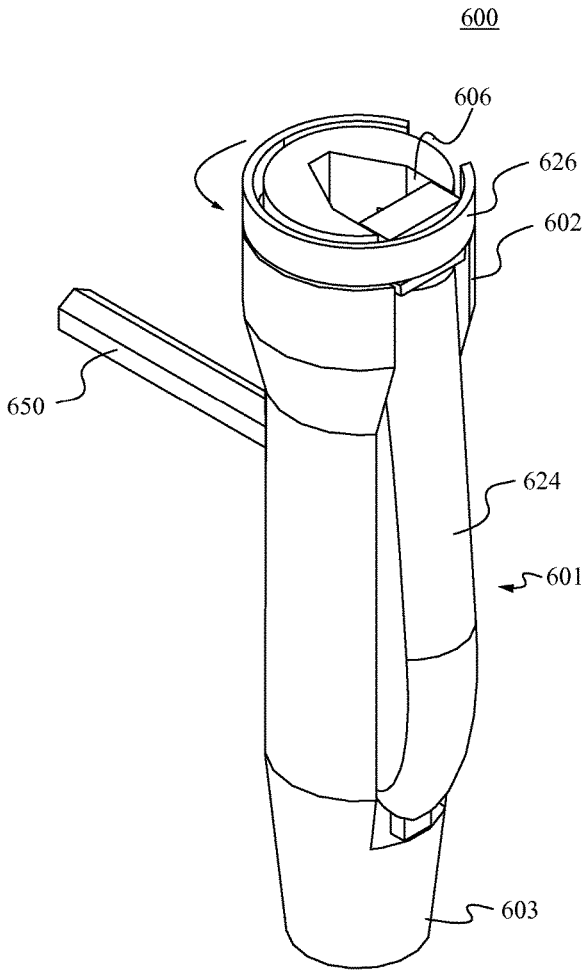

Alternatively, as shown in FIG. 6B, in some embodiments, the tool 650 is positioned within the tool handle 600 so that the long leg of the tool 650 extends from the back side of the tool handle 600. To position the tool 650 so that the long leg of the tool 650 extends from the back side of the tool handle 600, the long leg of the tool 650 is inserted into the opening 606 and through one of the one or more apertures of the back side of the body 601. Once the long leg has been inserted through one of the one or more apertures the securing mechanism 624 is moved to the closed position in order to confine the tool 650 within the tool handle 600. In some embodiments, a leg of the tool 650 is placed in an appropriate aperture 640 according to size.

As described above, the opening comprises a rectangular shaped channel with a v-shaped bottom. When an L-shaped hexagonal tool is placed within the tool handle, and the securing mechanism 524 (FIG. 5) is placed in a closed position, the adjustment component 560 pushes the tool to the bottom of the opening so that the tool is confined within the v-shaped bottom. As the size of the tool increases, the adjustment component 560 is pushed in an opposite direction toward the securing mechanism 524 in order to fit the larger tool. When the adjustment component 560 is pushed toward the securing mechanism 524, the one or more bars 562 and 562' fold in a direction toward the securing mechanism 524 as indicated by the arrows (FIG. 5) and the spring 564 retracts. In this manner, the tool handle is able to hold multiple tools of different sizes. Specifically, as the size of the hexagonal tool increases, the adjustment component 560 is pushed toward the securing mechanism 524 and the tool is confined within the groove.

When the tool is securely held within the tool handle 500, a user is able to easily install or remove an object such as a screw with the benefit of a comfortable handle. In some embodiments, the second end 503 of the tool handle 500 is ergonomically shaped so as to comfortably fit within a hand of a user. In some embodiments, the second end 503 of the tool handle 500 is rubber and/or textured in order to enable a user to easily grip the tool handle 500.

Particularly, when a L-shaped tool is held within the tool handle 500, the securing mechanism 524 applies a force to one side of the tool while the other sides of the tool are held stationary by a combination of the v-shaped channel of the opening 506 on one leg of the tool and one of the one or more apertures on the other leg of the tool and at a 90 degree orientation from opening 506. Additionally, since smaller sized L-shaped tools are inserted into the smaller apertures nearer to the first end 502 of the tool, the smaller tools protrude from the first end 502 at a similar proportion as the larger tools. Consequently, each tool has maximum linear support in the v-shaped channel while allowing for enough clearance away from the end of the channel to interact with a workpiece. Further, since each tool is held near the middle of the tool handle 500 in an operative position, a user is able to apply the maximum amount of force to the handle and to the workpiece.

Figure 7:
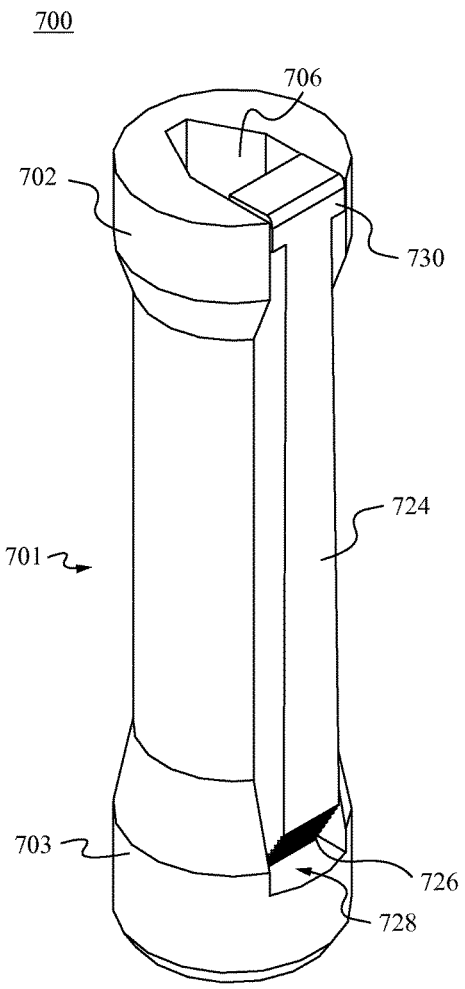
FIG. 7 illustrates a side perspective view of an adjustable tool handle for holding a tool during use in accordance with some embodiments.
Figure 8:
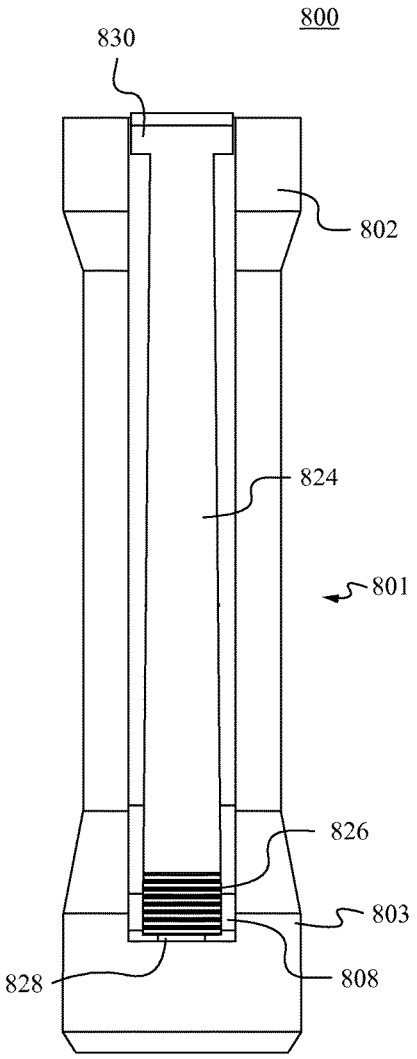
FIG. 8 illustrates a front view of an adjustable tool handle for holding a tool during use in accordance with some embodiments.

FIG. 7 illustrates a side perspective view of an adjustable tool handle for holding a tool during use in accordance with further embodiments. The tool handle 700 comprises a tool handle body 701 having a first end 702 and a second end 703, an opening 706, and a securing mechanism 724. As shown in FIG. 7, the opening 706 comprises a rectangular shaped opening with a v-shaped bottom to the channel. In some embodiments, the opening 706 and the tool handle 700 are configured for holding a L-shaped hexagonal tool. However, the channel is able to be any appropriate shape in the art and compatible with holding a tool. As described further below, the securing mechanism 724 is openable. In some embodiments, the securing mechanism 724 is opened by pulling the securing mechanism 724 away from the body 701 and rotating the securing mechanism about the bar 808 (FIG. 8). In some embodiments, the securing mechanism 724 comprises a notch 728 which interlocks with the bar 708 of the tool handle 700 to enable the securing mechanism 724 to rotate about the bar 708. In some embodiments, the securing mechanism 724 is removable from the tool handle 700. In some embodiments, the securing mechanism 724 comprises a gripping portion 726 to aid in gripping the securing mechanism 724 and the tool handle 700. When the securing mechanism 724 is opened, the opening 706 is able to be accessed and a tool is able to be removably coupled with the tool handle 700. In some embodiments, the second end 703 of the tool handle 700 is ergonomically shaped so as to comfortably fit into the hand of a user. In some embodiments, the second end 703 of the tool handle 700 is rubber and/or texturized in order to enable a user to easily grip the handle 700.

FIG. 8 illustrates a front view of an adjustable tool handle for holding a tool during use in accordance with some embodiments. The tool handle 800 comprises a tool handle body 801 having a first end 802 and a second end 803, an opening, and a securing mechanism 824. In further embodiments, the tool handle 800 comprises a lock. As shown in FIG. 8, when the securing mechanism 824 is in a closed position, the opening is blocked.

Figure 9:
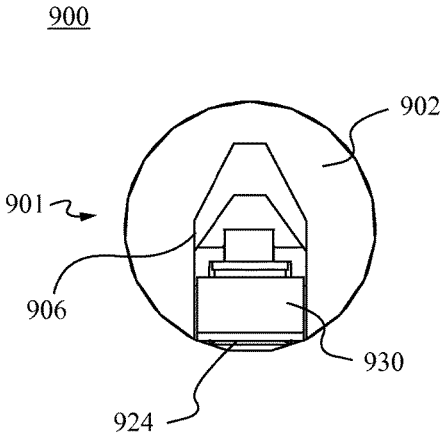
FIG. 9 illustrates a top view of an adjustable tool handle for holding a tool during use in accordance with some embodiments.

FIG. 9 illustrates a top view of an adjustable tool handle for holding a tool during use in accordance with some embodiments. The tool handle 900 comprises a body having a first end 902, an opening 906, and a securing mechanism 924. As shown in the top view, when the securing mechanism is in a closed position, the top portion 930 fits over the first end 902 of the tool handle 900 and interlocks with the opening 906.

Figure 10:
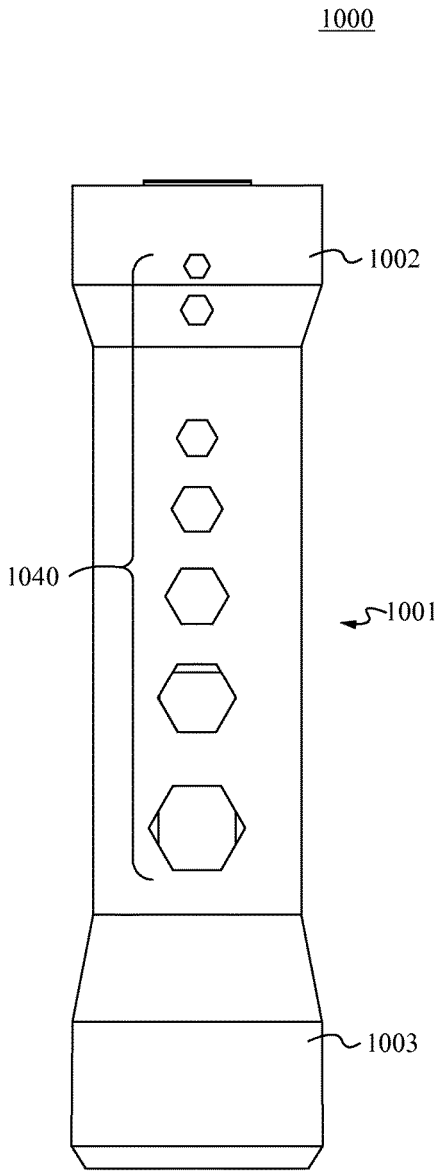
FIG. 10 illustrates a back view of an adjustable tool handle for holding a tool during use in accordance with some embodiments.

FIG. 10 illustrates a back view of the adjustable tool handle for holding a tool during use. The back view shows a tool handle 1000 comprising a body 1001 having a first end 1002 and a second end 1003, and one or more apertures 1040. As shown in FIG. 10, the one or more apertures 1040 are grouped in ascending order according to size. However, the one or more apertures 1040 are able to be grouped in any desired configuration. In some embodiments, the one or more apertures 1040 are hexagonally shaped. In some embodiments, a portion of a tool is inserted through one of the one or more apertures 1040 when the tool is removably coupled with the tool handle 1000.

Figure 11:
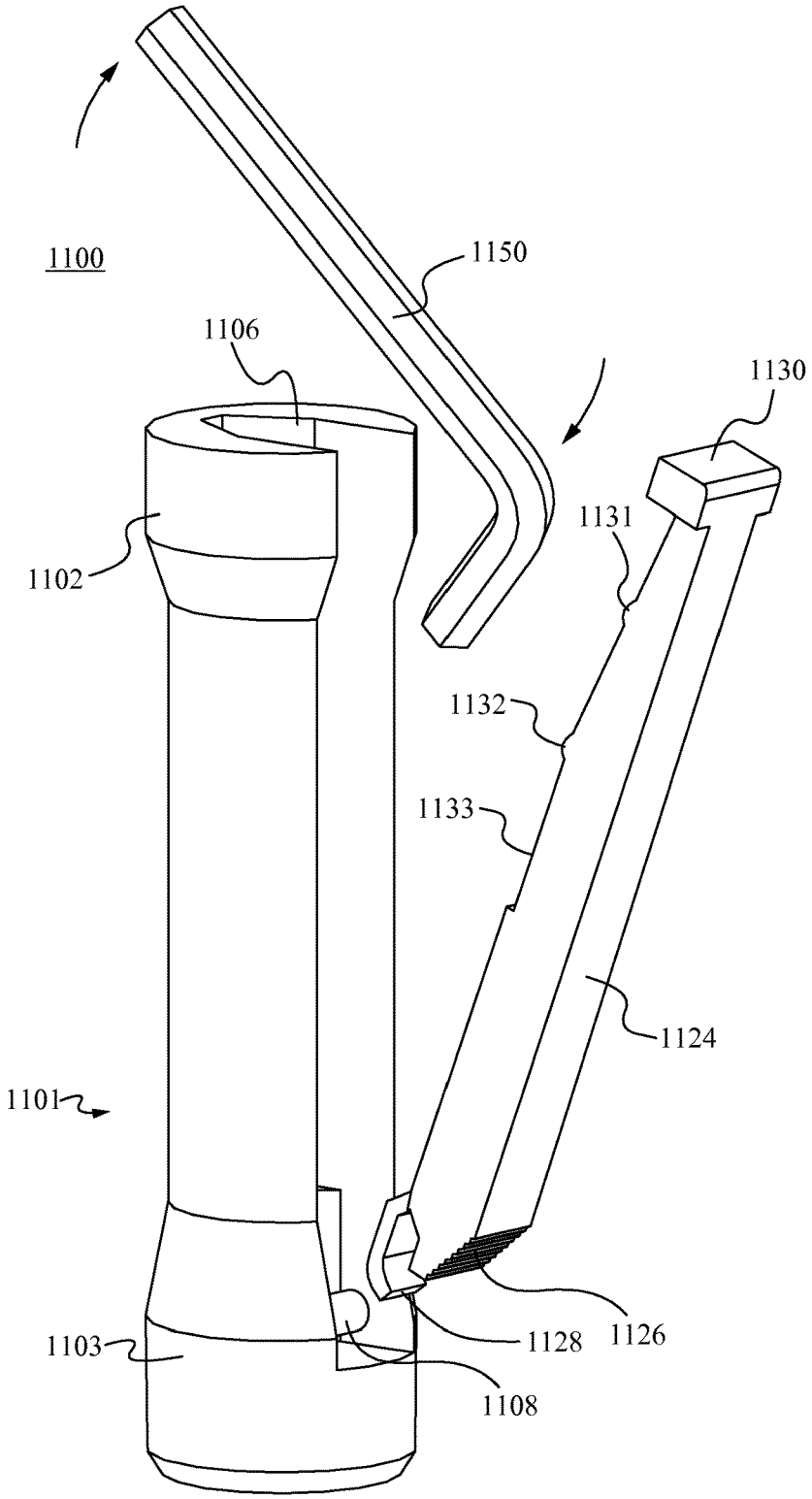
FIG. 11 illustrates a tool being coupled with an adjustable tool handle for holding a tool during use in accordance with some embodiments.

FIG. 11 illustrates a tool being coupled with an adjustable tool handle in accordance with some embodiments. The tool handle 1100 comprises a tool handle body 1101 having a first end 1102 and a second end 1103, an opening 1106, and a securing mechanism 1124. The securing mechanism 1124 is shown in an open position. As shown in FIG. 11, the notch 1128 comprises a curved portion of the securing mechanism 1124. The notch 1128 is configured to fit around and interlock with the bar 1108. As further shown within FIG. 11, the securing mechanism 1124 comprises one or more raised portions 1131 and 1132 and a lowered portion 1133.

Figure 12A:
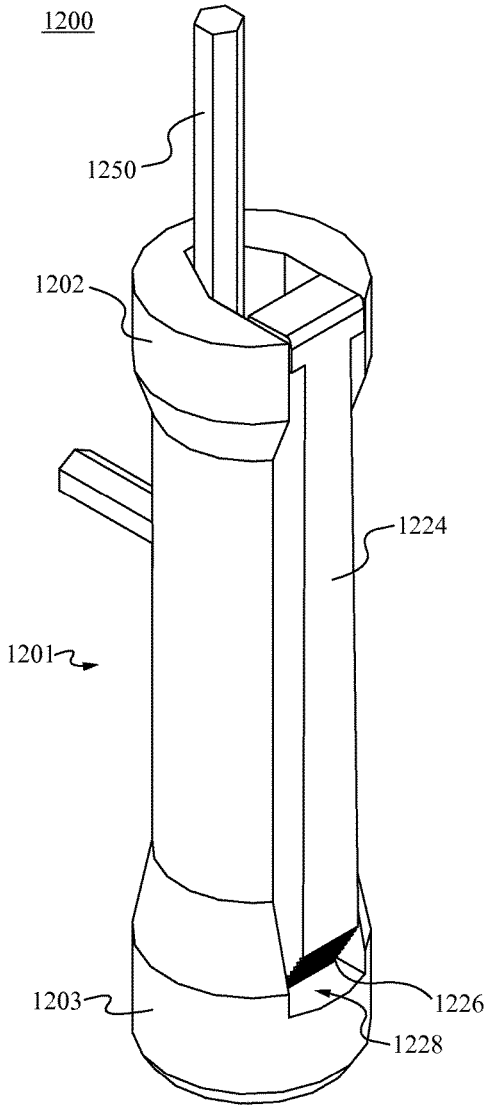
FIGS. 12A and 12B illustrate a tool coupled with an adjustable tool handle for holding a tool during use in accordance with some embodiments.

In some embodiments, in order to position a tool 1150 within the tool handle 1100 the short leg of a L-shaped hexagonal tool is inserted into the opening 1106. After the short leg is inserted into the opening 1106, the tool 1150 is turned and the short leg is inserted into an through one of the one or more apertures of the back side of the body 1101. Once the short leg has been inserted through one of the one or more apertures the securing mechanism 1124 is moved to the closed position in order to confine the tool 1150 within the tool handle 1100. As shown within FIG. 12A when the tool 1250 is positioned so that it extends from the first end of the tool handle 1200, the short end of the tool 1250 extends through one of the one or more apertures and from the back side of the tool handle.

Figure 12B:
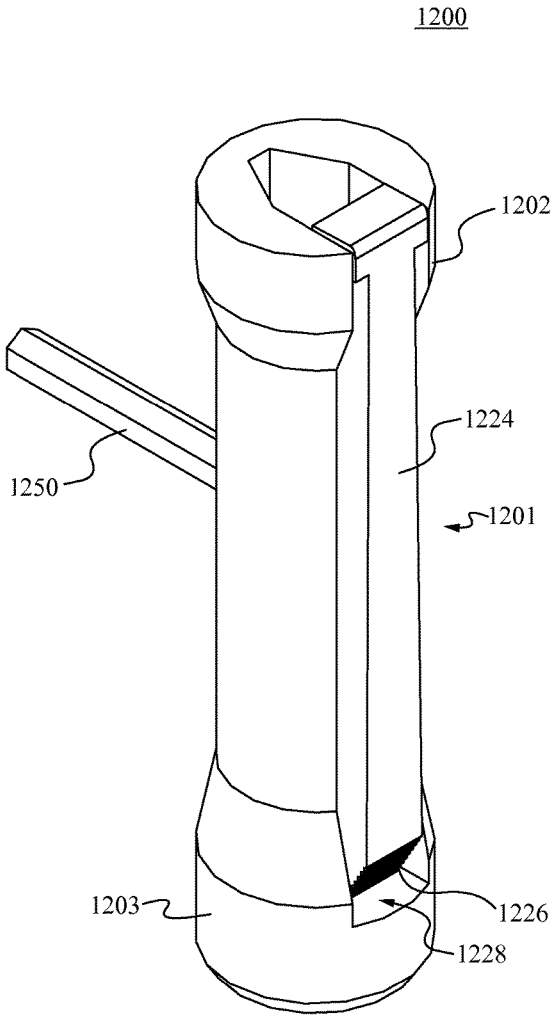

Alternatively, as shown in FIG. 12B, in some embodiments, the tool 1250 is positioned within the tool handle 1200 so that the long leg of the tool 1250 extends from the back side of the tool handle 1200. To position the tool 1250 so that the long leg of the tool 1250 extends from the back side of the tool handle 1200, the long leg of the tool 1250 is inserted into the opening 1206 and through one of the one or more apertures 1240 of the back side of the body 1201. Once the long leg has been inserted through one of the one or more apertures 1240 the securing mechanism 1224 is moved to the closed position in order to confine the tool 1250 within the tool handle 1200. In some embodiments, a leg of the tool 1250 is placed in an appropriate aperture 1240 according to size.

As described above, the opening comprises a rectangular shaped channel with a v-shaped bottom. When an L-shaped hexagonal tool is placed within the tool handle, and the securing mechanism 1224 is placed in a closed position, the tool is pushed to the bottom of the opening so that the tool is confined within the v-shaped bottom.

When the tool is securely held within the tool handle 1200, a user is able to easily install or remove an object such as a screw with the benefit of a comfortable handle. In some embodiments, the second end 1203 of the tool handle 1200 is ergonomically shaped so as to comfortably fit within a hand of a user. In some embodiments, the second end 1203 of the tool handle 1200 is rubber and/or textured in order to enable a user to easily grip the tool handle 1200.

As described above, when a L-shaped tool is held within the tool handle 1200, the securing mechanism 1224 applies a force to one side of the tool while the other sides of the tool are held stationary by a combination of the v-shaped channel of the opening 1206 on one leg of the tool and one of the one or more apertures on the other leg of the tool and at a 90 degree orientation from opening 1206. Additionally, since smaller sized L-shaped tools are inserted into the smaller apertures nearer to the first end 1202 of the tool, the smaller tools protrude from the first end 1202 at a similar proportion as the larger tools. Consequently, each tool has maximum linear support in the v-shaped channel while allowing for enough clearance away from the end of the channel to interact with a workpiece. Further, since each tool is held near the middle of the tool handle 1200 in an operative position, a user is able to apply the maximum amount of force to the handle and to the workpiece.

Figure 13:
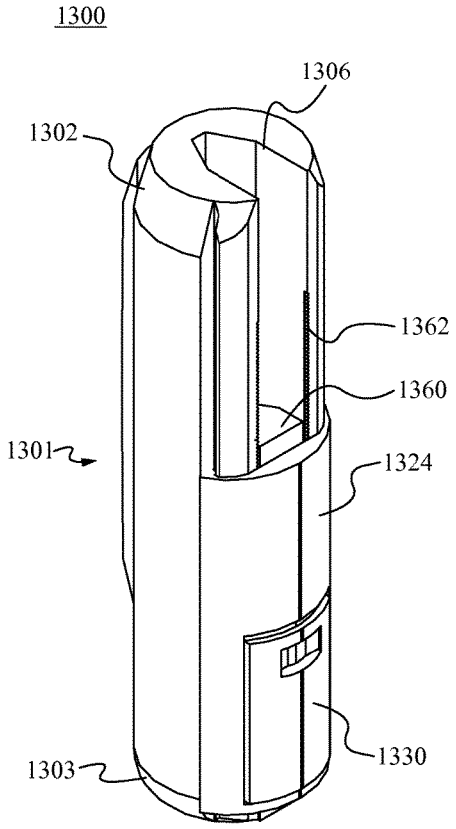
FIG. 13 illustrates a side perspective view of an adjustable tool handle for holding a tool during use in accordance with some embodiments.

FIG. 13 illustrates a side perspective view of an adjustable tool handle for holding a tool during use in accordance with further embodiments. The tool handle 1300 comprises a tool handle body 1301 having a first end 1302 and a second end 1303, an opening 1306, and a slidable securing mechanism 1324. As shown in FIG. 13, the opening 1306 comprises a rectangular shaped opening with a v-shaped bottom to the channel. In some embodiments, the opening 1306 and the tool handle 1300 are configured for holding a L-shaped hexagonal tool. However, the channel is able to be any appropriate shape in the art and compatible with holding a tool. As shown in FIG. 13, the slidable securing mechanism 1324 comprises a button 1330 and an adjustment component 1360. The slidable securing mechanism 1324 is slidable along the track 1362. In some embodiments, the track 1362 comprises a plurality of ratcheting teeth.

FIG. 13 illustrates the tool handle 1300 with the securing mechanism 1324 in an open configuration. When the tool handle 1300 and the securing mechanism 1324 are in an open configuration the opening 1306 is able to be accessed and a tool is able to be removably coupled with the tool handle 1300. In some embodiments, the second end 1303 of the tool handle 1300 is ergonomically shaped so as to comfortably fit into the hand of a user. In some embodiments, the second end 1303 of the tool handle 1300 is rubber and/or texturized in order to enable a user to easily grip the handle 1300.

Figure 14A:
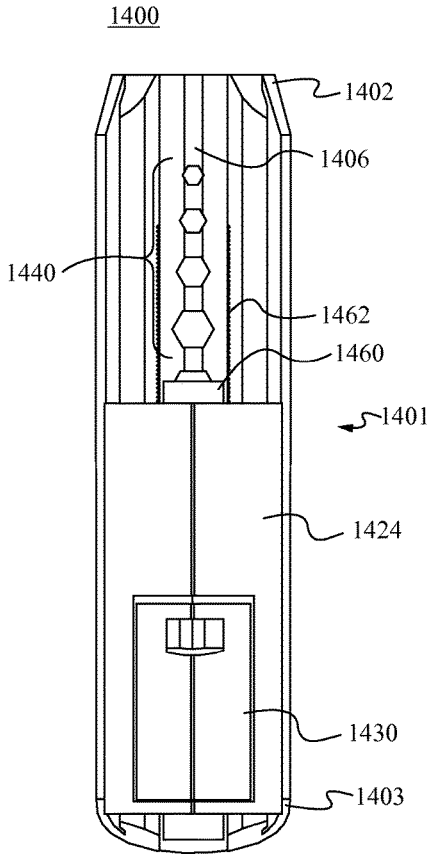
FIGS. 14A and 14B illustrate a front view of an adjustable tool handle for holding a tool during use in accordance with some embodiments.

FIG. 14A illustrates a front view of an adjustable tool handle for holding a tool during use in accordance with some embodiments. The tool handle 1400 comprises a tool handle body 1401 having a first end 1402 and a second end 1403, an opening 1406, and a securing mechanism 1424. As shown within FIG. 14A, when the securing when the tool handle 1400 and the securing mechanism 1424 are in an open configuration, one or more apertures 1440 of the back side of the tool handle are visible.

Figure 14B:
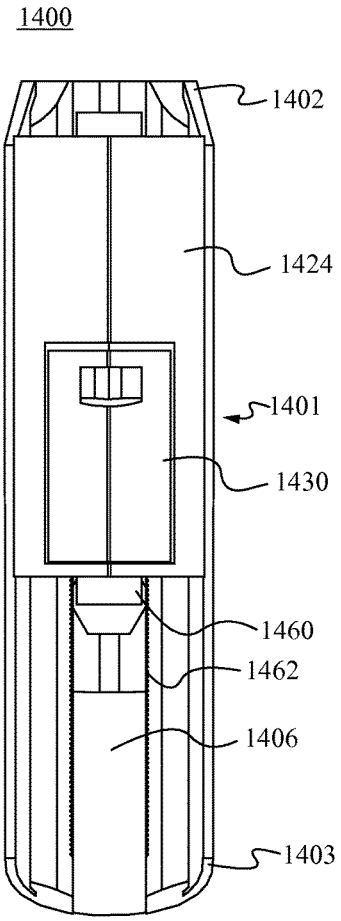

FIG. 14B illustrates a front view of the tool handle 1400 with the securing mechanism 1424 pushed to the top of the track 1462 and in a closed configuration. As the securing mechanism 1424 is pushed to the top of the track 1462, the adjustment component 1460 is pushed into the opening 1406. In some embodiments, once the securing mechanism 1424 is pushed to the top of the tool handle 1400 it is locked into place. In some embodiments, the securing mechanism 1424 is lockable in a plurality of positions along the track 1462. In further embodiments, once the securing mechanism 1424 is locked into place the button 1430 must be pushed in order to release the securing mechanism 1424 and slide it back down the track 1462.

Figure 15A:
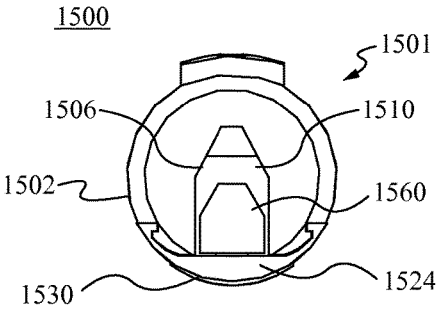
FIGS. 15A and 15B illustrate a top view of an adjustable tool handle for holding a tool during use in accordance with some embodiments.
Figure 15B:
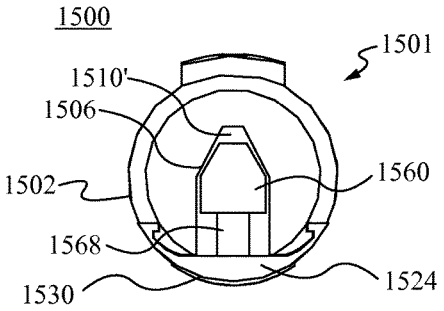

FIGS. 15A and 15B illustrate a top view of an adjustable tool handle for holding a tool during use in accordance with some embodiments. FIG. 15A shows the securing mechanism 1524 in an open configuration and FIG. 15B shows the securing mechanism 1524 in a closed configuration. The tool handle 1500 comprises a body having a first end 1502, an opening 1506, a securing mechanism 1524, and an adjustable aperture 1510. As shown in FIG. 15A, when the securing mechanism 1524 is in an open configuration the adjustment component is in a bottom of the tool handle 1500 and the adjustable aperture 1510 is a first size. As the securing mechanism 1524 is pushed up the track, the adjustment component 1560 moves into the opening 1506 and the adjustable aperture 1510 becomes smaller. The securing mechanism 1524 is able to be moved up and down the track, in order to change the size of the adjustable aperture 1510. For example, as shown in FIG. 15B when the securing mechanism 1524 and the adjustment component 1560 are pushed to the top of the track, the aperture 1510' is substantially smaller than the aperture 1510. As further shown in FIG. 15B, in some embodiments, one or more track grooves 1568 push the adjustment component 1560 into the opening 1506 as the securing mechanism is pushed to a top of the track.

Figure 16:
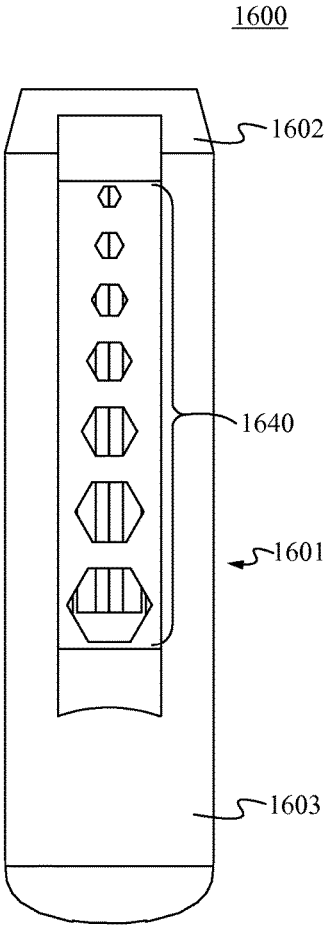
FIG. 16 illustrates a back view of an adjustable tool handle for holding a tool during use in accordance with some embodiments.

FIG. 16 illustrates a back view of the adjustable tool handle for holding a tool during use. The back view shows a tool handle 1600 comprising a body 1601 having a first end 1602 and a second end 1603, and one or more apertures 1640. As shown in FIG. 16, the one or more apertures 1640 are grouped in ascending order according to size. However, the one or more apertures 1640 are able to be grouped in any desired configuration. In some embodiments, the one or more apertures 1640 are hexagonally shaped. In some embodiments, a portion of a tool is inserted through one of the one or more apertures 1640 when the tool is removably coupled with the tool handle 1600.

Figure 17A:
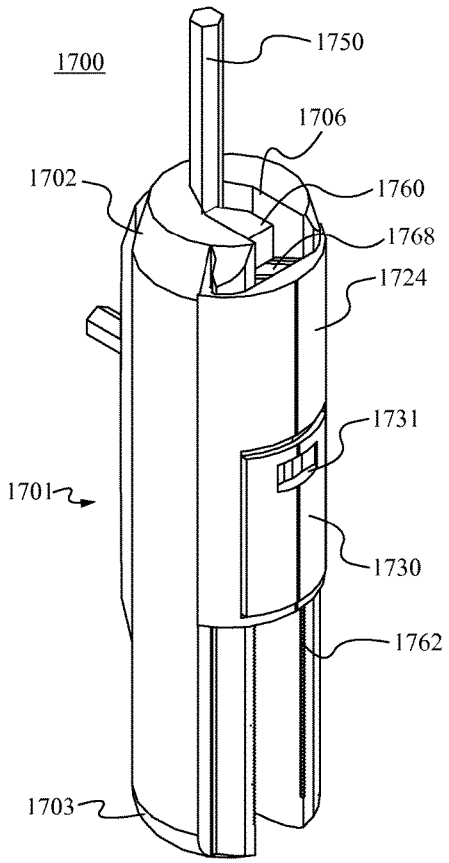
FIGS. 17A and 17B illustrate a tool coupled with an adjustable tool handle for holding a tool during use in accordance with some embodiments.
Figure 17B:
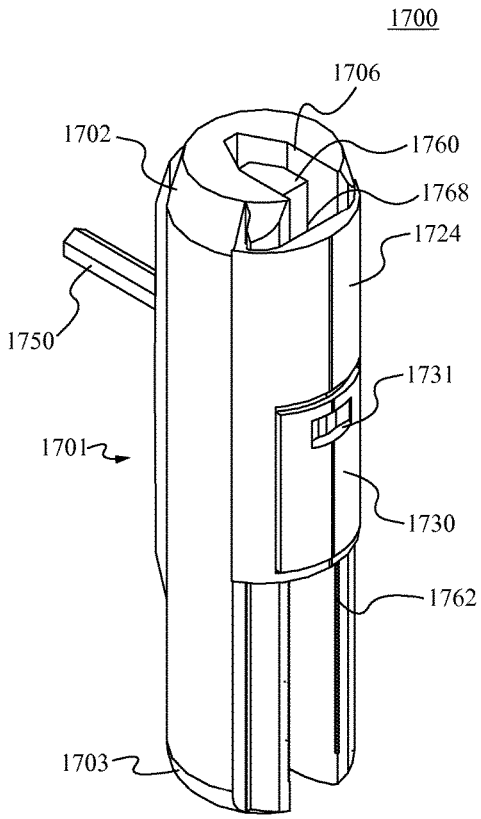

FIGS. 17A and 17B show a tool coupled with an adjustable tool handle in accordance with some embodiments. The tool handle 1700 comprises a tool handle body 1701 having a first end 1702 and a second end 1703, an opening 1706, and a securing mechanism 1724. As described above, in some embodiments, in order to position a tool 1750 within the tool handle 1700, with the securing mechanism 1724 in an opened configuration, the short leg of a L-shaped hexagonal tool is inserted into the opening 1706. After the short leg is inserted into the opening 1706, it is inserted into and through one of the one or more apertures of the back side of the body 1701. Once the short leg has been inserted through one of the one or more apertures the securing mechanism 1724 is pushed up the track 1762 and moved to a closed configuration in order to confine the tool 1750 within the tool handle 1700. More specifically, the securing mechanism 1724 is pushed up the track 1762 until the track the adjustment component 1760 has pushed the tool 1750 into the opening 1706. The securing mechanism 1724 is able to be moved up and down the track 1762 depending on the size of the tool. As shown within FIG. 17A when the tool 1750 is positioned so that it extends from the first end of the tool handle 1700, the short end of the tool 1750 extends through one of the one or more apertures 1740 and from the back side of the tool handle.

Alternatively, as shown in FIG. 17B, in some embodiments, the tool 1750 is positioned within the tool handle 1700 so that the long leg of the tool 1750 extends from the back side of the tool handle 1700. To position the tool 1750 so that the long leg of the tool 1750 extends from the back side of the tool handle 1700, with the securing mechanism 1724 in an opened configuration, the long leg of the tool 1750 is inserted into the opening 1706 and through one of the one or more apertures of the back side of the body 1701. Once the long leg has been inserted through one of the one or more apertures the securing mechanism 1724 is pushed up the track 1762 and moved to a closed configuration in order to confine the tool 1750 within the tool handle 1700. In some embodiments, a leg of the tool 1750 is placed in an appropriate aperture according to size.

As described above, the opening comprises a rectangular shaped channel with a v-shaped bottom. When an L-shaped hexagonal tool is placed within the tool handle, and the securing mechanism 1724 is placed in a closed position, the tool is pushed to the bottom of the opening so that the tool is confined within the v-shaped bottom. In this manner, the tool handle is able to hold multiple tools of different sizes. Specifically, the securing mechanism 1724 is pushed up the track 1762 until the adjustment mechanism 1760 has pushed the tool into the bottom of the opening the tool 1762 is securely held in place.

When the tool is securely held within the tool handle 1700, a user is able to easily install or remove an object such as a screw with the benefit of a comfortable handle. In some embodiments, the second end 1703 of the tool handle 1700 is ergonomically shaped so as to comfortably fit within a hand of a user. In some embodiments, the second end 1703 of the tool handle 1700 is rubber and/or textured in order to enable a user to easily grip the tool handle 1700.

Particularly, when a L-shaped tool is held within the tool handle 1700, the securing mechanism 1724 applies a force to one side of the tool while the other sides of the tool are held stationary by a combination of the v-shaped channel of the opening 1706 on one leg of the tool and one of the one or more apertures on the other leg of the tool and at a 90 degree orientation from opening 1706. Additionally, since smaller sized L-shaped tools are inserted into the smaller apertures nearer to the first end 1702 of the tool, the smaller tools protrude from the first end 1702 at a similar proportion as the larger tools. Consequently, each tool has maximum linear support in the v-shaped channel while allowing for enough clearance away from the end of the channel to interact with a workpiece. Further, since each tool is held near the middle of the tool handle 1700 in an operative position, a user is able to apply the maximum amount of force to the handle and to the workpiece.

When an L-shaped hexagonal or round tool is placed within the tool handle, the securing mechanism pushes the tool so that the tool is confined within the v-shaped bottom. In this manner, the tool handle is able to hold multiple tools of different sizes. Specifically, as the size of the tool decreases, it is pushed farther into the v-shaped bottom.

In some embodiments, the adjustable tool handle for holding a tool during use is designed to be utilized with hexagonal wrenches of English sizes including a 9/32 inch hexagonal wrench, a 1/4 inch hexagonal wrench, a 7/32 inch hexagonal wrench, a 3/16 inch hexagonal wrench, a 5/32 inch hexagonal wrench, a 9/64 inch hexagonal wrench, a 1/8 inch hexagonal wrench, a 7/64 inch hexagonal wrench, a 3/32 inch hexagonal wrench and a 5/64 inch hexagonal wrench.

In some embodiments, the adjustable tool handle for holding a tool during use is also designed to be utilized with hexagonal wrenches of metric sizes including a 10 mm hexagonal wrench, an 8 mm hexagonal wrench, a 6 mm hexagonal wrench, a 5 mm hexagonal wrench, a 4.5 mm hexagonal wrench, a 4 mm hexagonal wrench, a 3.5 mm hexagonal wrench, a 3 mm hexagonal wrench, a 2.5 mm hexagonal wrench and a 2 mm hexagonal wrench.

Alternatively, the adjustable tool handle for holding a tool during use is able to be used with tools other than hexagonal wrenches. For example, a flat screwdriver is able to be used with the tool handle by including it on the end of a hexagonal L-shaped tool. Alternatively, a phillips screwdriver is also able to used with the tool handle by also including it on the end of a hexagonal L-shaped tool. In some embodiments, the tool handle is used with tools including a square head screwdriver, a star head screwdriver, and other tools.

Figure 18A:
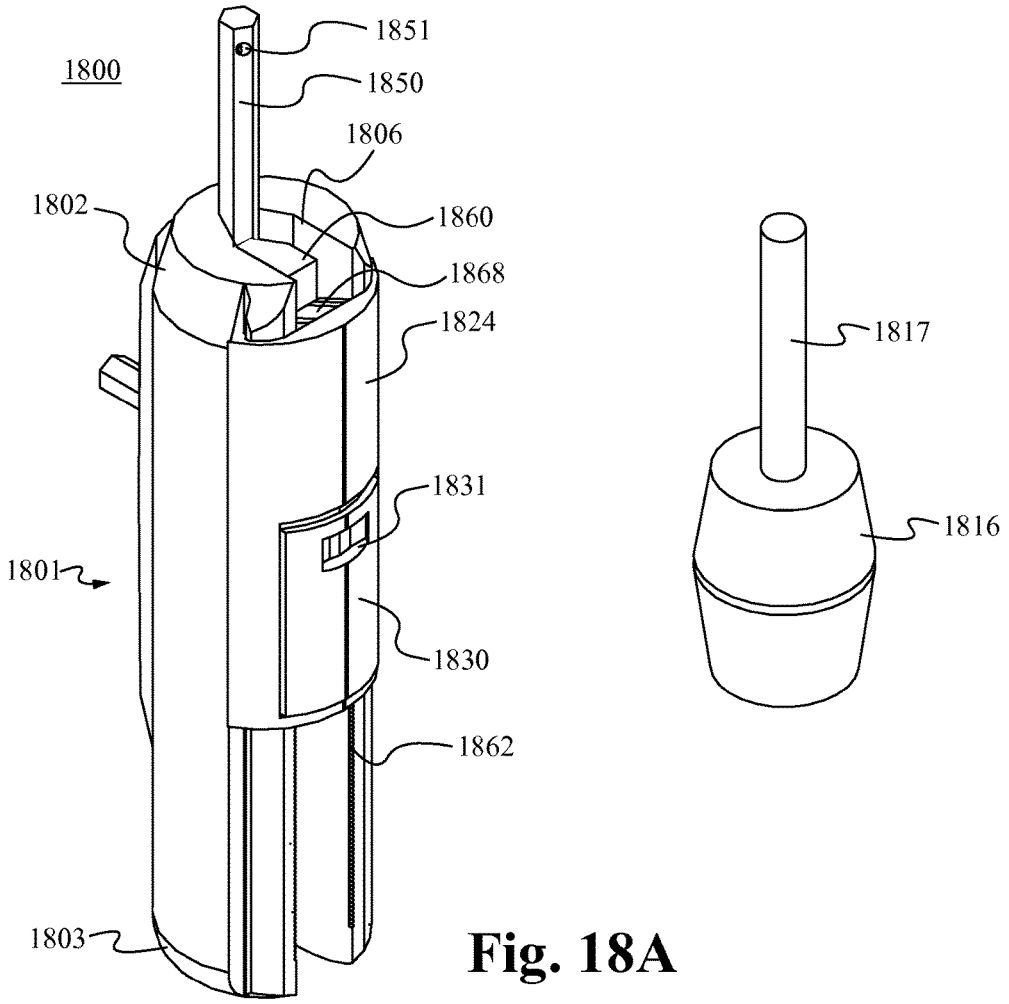
FIGS. 18A-18C illustrate an adjustable tool handle with a ratcheting mechanism for holding a tool during use in accordance with some embodiments.
Figure 18B:
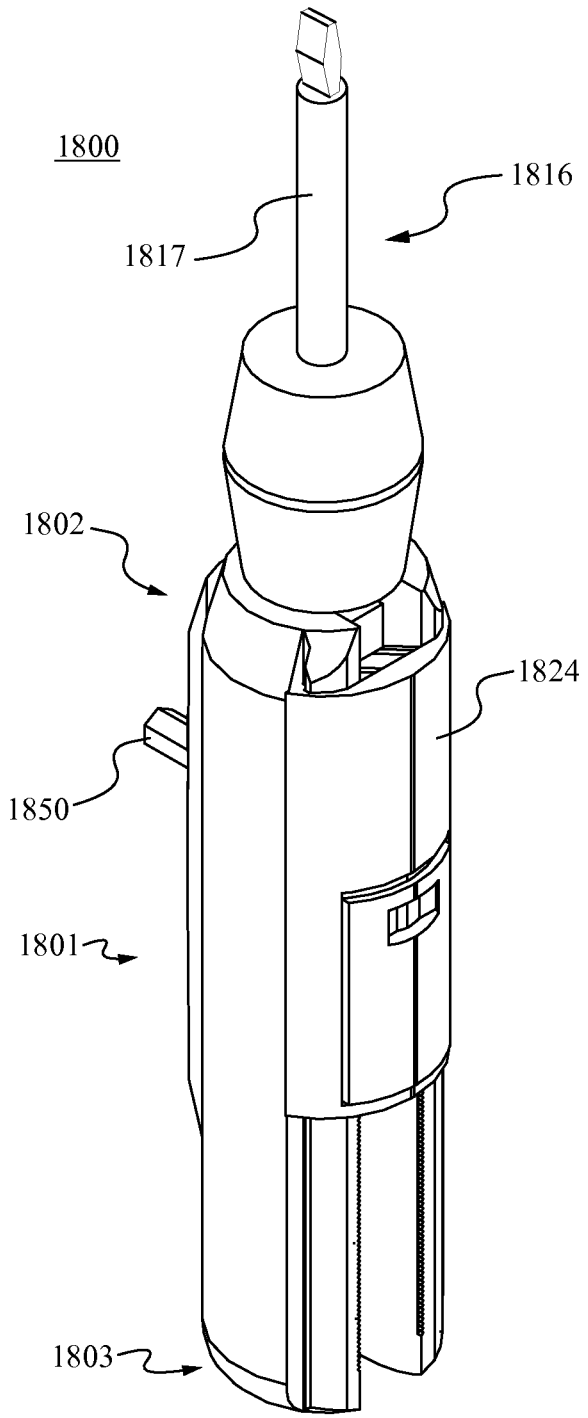
Figure 18C:
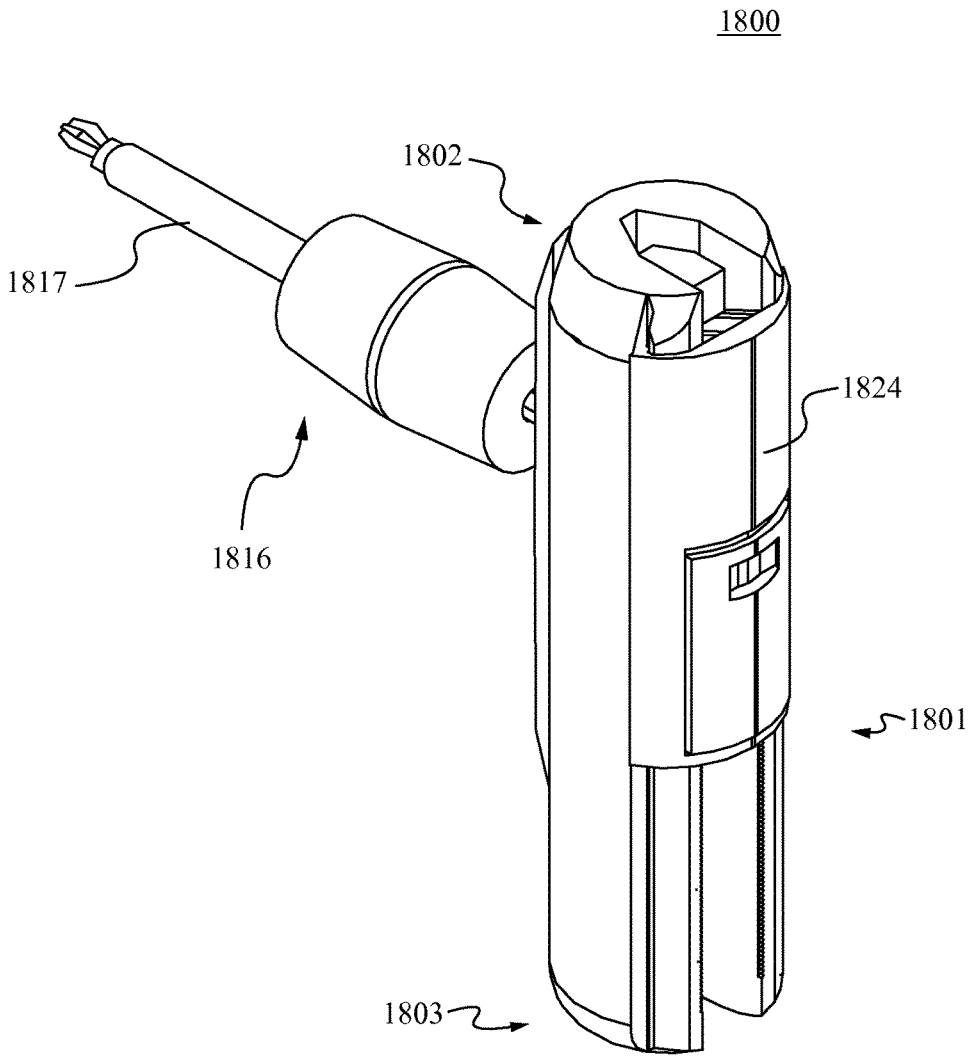

In some embodiments, the adjustable tool handle for holding a tool during use is able to be coupled with a ratcheting mechanism. FIGS. 18A-18C illustrate a tool set including an adjustable tool handle for holding a tool during use and a ratcheting mechanism in accordance with some embodiments. As shown in FIG. 18A, the adjustable tool handle 1800 comprises a tool handle body 1801 having a first end 1802, a second end 1803, an opening 1806, a slidable button 1804, and a securing mechanism 1824. The tool handle 1800 is coupled with a L-shaped hexagonal tool 1850. In some embodiments, the tool 1850 comprises one or more ball detents 1851 on the long leg of the tool 1850 and/or the short leg of the tool 1850. The ratcheting mechanism 1816 is removably coupled with the tool handle 1800 by pushing the ratcheting mechanism 1816 over the one or more ball detents 1851 of the tool 1850. In this manner, the ratchet mechanism 1816 is quickly and easily changed from the first end 1802 of the tool 1800 to the side of the tool 1800 without opening the handle 1800 and operating the securing mechanism 1824. In some embodiments, the tool 1850 is a L-shaped 1/4 hexagonal wrench.

As further shown in FIG. 18A, the ratcheting mechanism 1816 comprises a stem 1817. The stem 1817 is able to couple with bits of different sizes and different types in order to tighten or loosen nuts and bolts of different types and sizes. For example, in some embodiments, the ratcheting mechanism 1816 removably couples with bits consisting of a flat head screwdriver, a phillips head screwdriver, a square head screwdriver, a star head screwdriver, and other tools. In some embodiments, the stem 1817 of the ratcheting mechanism 1816 couples with a socket. Alternatively, in some embodiments, the ratcheting mechanism 1816 is able to be used with a hexagonal or round tool. As will be apparent to someone of ordinary skill in the art, the ratcheting mechanism 1816 is able to be used with any appropriate tool. The ratcheting mechanism 1816 is able to be configured either clockwise or counterclockwise so that the ratchet mechanism allows the tool to be turned in the specified direction which enables the user to either install or remove an object. In some embodiments, this is done by twisting the ratcheting mechanism 1816.

FIGS. 18B and 18C show the tool handle 1800 removably coupled with the ratcheting mechanism 1816 in accordance with some embodiments. As shown in FIG. 18B, the ratcheting mechanism 1816 is removably coupled with the tool handle 1800 to extend from the first end 1802 of the tool handle 1800. In FIG. 18B, the stem 1817 of the ratcheting mechanism 1816 is removably coupled with a bit in the shape of a flat head screwdriver. FIG. 18C, shows the ratcheting mechanism 1816 removably coupled with the tool handle 1800 to extend from the side of the tool handle 1800. In FIG. 18C, the stem 1817 of the ratcheting mechanism 1816 is removably coupled with a bit in the shape of a phillips head screwdriver. Although, FIGS. 18B and 18C show the stem 1817 removably coupled with bits in the shape of a flathead screwdriver and a phillips head screwdriver, as described above, the stem 1817 is able to couple with bits of different sizes and different types in order to tighten or loosen nuts and bolts of different types and sizes. With the tool 1850 comprising one or more ball detents 1851 coupled with the tool handle 1800, a user is able to quickly and easily couple the ratcheting mechanism 1816 with the first end 1802 of the tool 1800 and the side of the tool 1800 without opening the handle 1800 and operating the securing mechanism 1824. In this manner, a user is able to place the ratcheting mechanism 1816 in an ideal location and configuration in order to reach a workpiece.

The adjustable tool handle for holding a tool during use is able to be composed of any appropriate material, which is of maximum strength and includes properties which resist materials that the handle will likely be exposed to, e.g., oil, grease, gasoline and the like. In some embodiments, the tool handle is materially composed of a variety of resin polymer and copolymer compositions including fillers and reinforcing materials such as glass in order to meet the strength and chemical resistance requirements of the tool. In some embodiments, the tool handle is materially composed of any suitable composition including, but not limited to aluminum or steel. In some embodiments, the tools are materially composed of aluminum, steel or any other appropriate material.

In some embodiments, the adjustable tool handle for holding a tool during use is constructed using an injection molded, core/cavity process as is well known in the art. Alternatively, the tool handle is able to be constructed in any known manner.

To utilize the adjustable tool handle for holding a tool during use, a tool is placed within the tool handle where it is held in place by a securing mechanism. In some embodiments, the tool is a L-shaped hexagonal or round tool. Once the tool is positioned and held within the adjustable tool handle, a user is able to easily install or remove an object such as a screw with the benefit of a comfortable handle.

The adjustable tool handle is able to be used with the tool extending out of the end of the tool handle or with the tool extending from the side of the tool handle. Consequently, a user is able to select the configuration which allows a user to achieve the greatest convenience and the most leverage for their desired task. Particularly, when a tool is inserted into the tool handle it is held into place on two legs of the tool, which are positioned at a right angle. The securing mechanism applies a force to one side of the tool while the other sides of the tool are held stationary by a combination of the v-shaped channel of the opening on one leg of the tool and one of the one or more apertures on the other leg of the tool and at a 90 degree orientation from opening. Additionally, since smaller sized L-shaped tools are inserted into the smaller apertures nearer to the first end of the tool, the smaller tools protrude from the first end at a similar proportion as the larger tools. Consequently, each tool has maximum linear support in the v-shaped channel while allowing for enough clearance away from the end of the channel to interact with a workpiece. Further, since each tool is held near the middle of the tool handle in an operative position, a user is able to apply the maximum amount of force to the handle and to the workpiece.

The adjustable tool handle for holding a tool during use provides comfort and speed for installing and removing objects such as screws and bolts. In operation, the adjustable tool handle for holding a tool during use provides comfort and speed for installing and removing objects such as screws and bolts.

The present invention has been described in terms of specific embodiments incorporating details to facilitate the understanding of principles of construction and operation of the invention. Such reference herein to specific embodiments and details thereof is not intended to limit the scope of the claims appended hereto. It will be readily apparent to one skilled in the art that other various modifications may be made in the embodiment chosen for illustration without departing from the spirit and scope of the invention as defined by the appended claims.

What is claimed is:

1. A tool set comprising:

a. a tool handle comprising:

i. a first adjustable opening comprising a v-shaped channel for removably holding one of a plurality of sized tools during use; and ii. a plurality of differently sized apertures within a side of the tool, each aperture for removably holding an appropriately sized one of the plurality of sized tools during use wherein the plurality of differently sized apertures are separate and distinct from the first adjustable opening; and b. a ratcheting mechanism that detachably couples to the tool handle and extends from a first end or a side of the tool handle during use, and wherein the ratcheting mechanism separately holds one of a plurality of bits or sockets during use.

2. The tool set of claim 1 wherein a securing mechanism of the tool handle is manually moved from a closed position to an open position in order to place the one of a plurality of sized tools within the first adjustable opening of the tool handle and is manually returned to the closed position in order to hold the one of a plurality of sized tools within the first adjustable opening.

3. The tool set of claim 1 wherein the ratcheting mechanism removably couples to the first end of the tool handle.

4. The tool set of claim 1 wherein the ratcheting mechanism removably couples to the side of the tool handle.

5. The tool set of claim 1 wherein the ratcheting mechanism removably receives one of a plurality of bits or sockets, each sized to fit a different sized work piece.

6. The tool set of claim 1 wherein the ratcheting mechanism removably receives one or more of a hexagonal bit, a flathead bit, a phillips head bit, a square head bit, a star head bit, and other shaped bits.

7. The tool set of claim 1 wherein the tool handle comprises a lock.

8. The tool set of claim 1 wherein the ratcheting mechanism removably couples with the one of a plurality of sized tools.

9. A tool set comprising:

a. a tool handle comprising a first adjustable opening comprising a v-shaped channel for removably holding one of a plurality of differently sized tools during use, wherein the tool handle comprises i. a body having a first end and a second end;

ii. a first adjustable opening for receiving one of a plurality of tools of different sizes;

iii. a plurality of differently sized apertures within a side of the tool, each aperture for receiving an appropriately sized one of the plurality of differently sized tools wherein the plurality of differently sized apertures are separate and distinct from the first adjustable opening; and iv. a lock;

wherein an operable end of the one of a plurality of differently sized tools extends from the first end or the side of the tool handle during use; and b. a ratcheting mechanism that detachably couples to the tool handle and extends from the first end or a side of the tool handle during use, and wherein the ratcheting mechanism separately holds one of a plurality of bits or sockets during use.

10. The tool set of claim 9 wherein a securing mechanism of the tool handle is manually moved from a closed position to an open position in order to place the one of a plurality of differently sized tools tool within the first adjustable opening of the tool handle and is manually returned to the closed position in order to hold the tool within the adjustable opening.

11. The tool set of claim 9 wherein the ratcheting mechanism removably couples to the first end of the tool handle.

12. The tool set of claim 9 wherein the ratcheting mechanism removably couples to the side of the tool handle.

13. The tool set of claim 9 wherein the ratcheting mechanism removably receives one of a plurality of bits or sockets, each sized to fit a different sized work piece.

14. The tool set of claim 9 wherein the ratcheting mechanism removably receives one or more of a hexagonal bit, a flathead bit, a phillips head bit, a square head bit, a star head bit, and other shaped bits.

15. The tool set of claim 9 wherein the ratcheting mechanism removably couples with the one of a plurality of differently sized tools.

* * * * *